US008967277B2

(12) United States Patent
Steele et al.

(10) Patent No.: US 8,967,277 B2
(45) Date of Patent: Mar. 3, 2015

(54) VARIABLY CONFIGURABLE WELLBORE JUNCTION ASSEMBLY

(75) Inventors: David J. Steele, Arlington, TX (US); Jean-Michel Ranjeva, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 418 days.

(21) Appl. No.: 13/152,759

(22) Filed: Jun. 3, 2011

(65) Prior Publication Data

US 2012/0305266 A1 Dec. 6, 2012

(51) Int. Cl.

| | |
|---|---|
| ***E21B 19/16*** | (2006.01) |
| ***E21B 17/00*** | (2006.01) |
| ***E03B 3/11*** | (2006.01) |
| ***E21B 17/04*** | (2006.01) |
| ***E21B 41/00*** | (2006.01) |
| ***E21B 47/024*** | (2006.01) |
| ***E21B 34/06*** | (2006.01) |

(52) U.S. Cl.

CPC ..... *E21B 17/04* (2013.01); *E21B 41/0035* (2013.01); *E21B 47/024* (2013.01); *E21B 34/06* (2013.01)

USPC ..... 166/380; 166/242.6; 166/50

(58) Field of Classification Search

USPC ..... 166/313, 380, 242.6, 50, 242.3, 242.5, 166/241.6, 373, 316

See application file for complete search history.

(56) References Cited

U.S. PATENT DOCUMENTS 1,547,461 A * 7/1925 Steele ..... 175/60
3,871,450 A * 3/1975 Jett et al. ..... 166/319
4,913,228 A * 4/1990 Setterberg, Jr. ..... 166/118
5,330,007 A 7/1994 Collins et al.
5,427,177 A * 6/1995 Jordan et al. ..... 166/50
5,560,435 A * 10/1996 Sharp ..... 175/5
5,806,614 A * 9/1998 Nelson ..... 175/61
5,816,326 A * 10/1998 Slater ..... 166/369
5,845,707 A 12/1998 Longbottom
5,944,109 A * 8/1999 Longbottom ..... 166/313
5,960,873 A 10/1999 Alexander
5,964,289 A 10/1999 Hill
5,979,560 A 11/1999 Nobileau (Continued)

OTHER PUBLICATIONS

International Search Report and Written Opinion issued Dec. 21, 2012 for PCT Application No. PCT/US2012/038671, 9 pages.

(Continued)

*Primary Examiner* — Kenneth L Thompson
*Assistant Examiner* — Michael Wills, III
(74) *Attorney, Agent, or Firm* — Chamberlain Hrdlicka

(57) ABSTRACT

A method of installing a wellbore junction assembly in a well can include connecting at least two tubular strings to one opposite end of a tubular string connector with similarly dimensioned oriented connections, whereby the tubular strings are interchangeably connectable to the connector by the oriented connections. A wellbore junction assembly can include at least two tubular strings and a tubular string connector having opposite ends. Each of the tubular strings may be secured to one opposite end of the connector by oriented connections, whereby each of the tubular strings has a fixed rotational orientation relative to the connector. A well system can include a tubular string connector, each of first and second tubular strings being secured to the connector, and a support which reduces bending of the second tubular string which results from deflection of the second tubular string from one wellbore section into another wellbore section.

22 Claims, 23 Drawing Sheets

(56) References Cited

U.S. PATENT DOCUMENTS

| | | | | |
|---|---|---|---|---|
| 6,035,937 | A | 3/2000 | Gano et al. | |
| 6,073,697 | A | 6/2000 | Parlin et al. | |
| 6,079,494 | A * | 6/2000 | Longbottom et al. | 166/313 |
| 6,142,235 | A | 11/2000 | Monjure et al. | |
| 6,158,513 | A | 12/2000 | Nistor et al. | |
| 6,253,852 | B1 | 7/2001 | Nobileau | |
| 6,390,137 | B1 * | 5/2002 | Ewald et al. | 138/114 |
| 6,390,198 | B2 | 5/2002 | Brooks et al. | |
| 6,431,283 | B1 * | 8/2002 | Dale | 166/341 |
| 6,561,277 | B2 * | 5/2003 | Algeroy et al. | 166/373 |
| 6,712,148 | B2 | 3/2004 | Fipke et al. | |
| 6,729,410 | B2 | 5/2004 | Steele | |
| 6,789,628 | B2 | 9/2004 | Hess et al. | |
| 6,907,930 | B2 * | 6/2005 | Cavender et al. | 166/313 |
| 7,219,746 | B2 | 5/2007 | Nobileau | |
| 7,275,598 | B2 | 10/2007 | Steele | |
| 7,299,878 | B2 | 11/2007 | Steele | |
| 7,320,366 | B2 * | 1/2008 | Steele et al. | 166/381 |
| 7,497,264 | B2 * | 3/2009 | Moody et al. | 166/313 |
| 2002/0079102 | A1 | 6/2002 | Dewey | |
| 2002/0112857 | A1 | 8/2002 | Ohmer et al. | |
| 2002/0121375 | A1 | 9/2002 | Ohmer et al. | |
| 2003/0221834 | A1 * | 12/2003 | Hess et al. | 166/313 |
| 2004/0168809 | A1 | 9/2004 | Nobileau | |
| 2005/0061511 | A1 | 3/2005 | Steele | |
| 2005/0121190 | A1 * | 6/2005 | Oberkircher et al. | 166/250.1 |
| 2006/0201677 | A1 | 9/2006 | Moody | |
| 2009/0045368 | A1 | 2/2009 | Cowie et al. | |
| 2010/0319934 | A1 | 12/2010 | Ervin | |
| 2012/0305266 | A1 | 12/2012 | Steele et al. | |
| 2012/0305267 | A1 * | 12/2012 | Steele | 166/380 |
| 2012/0305268 | A1 | 12/2012 | Steele | |
| 2014/0000914 | A1 | 1/2014 | Steele | |

OTHER PUBLICATIONS

U.S. Appl. No. 13/152,892, filed Jun. 3, 2011, 18 pages.
Drawings for U.S. Appl. No. 13/152,892, 1 page.
Dresser Industries, Inc.; "P-Tubing Control Valve", injection valve assembly model, drawing 94417, dated Aug. 11, 2003, 1 page.
American Oil & Gas Reporter; "Tubulars Technology: New Tubular and Connections Capabilities Overcome Downhole Challenges", newspaper article, dated Sep. 2005, 5 pages.
Halliburton; "Mirage Disappearing Plug and Autofill Sub", H00093, dated Jun. 2010, 2 pages.
Halliburton; "SperryRite Advanced Reservoir Drainage Services", H02576, Sep. 2007, 2 pages.
Halliburton; "ReFlexRite Milled Exit Isolated Tie-Back Multilateral System", H05737, Jun. 2009, 2 pages.
Halliburton; "DP1 Anvil Plugging System", H06466, dated Sep. 2008, 2 pages.
Halliburton; "Advanced Reservoir Drainage Solutions: Two Production Wells in Different Pressured Reservoirs Receive High-Pressure Water Injection from Multilateral Well", H06600, dated Jun. 2009, 2 pages.
Halliburton; "SperryRite Multilateral Systems", H07438, Jan. 2010, 15 pages.
Vallourec 7 Mannesmann Tubes; "VAM-FJL: No Gamble with the Royal Flush", created prior to May 18, 2011, 3 pages.
International Search Report with Written Opinion issued Nov. 7, 2012 for PCT Patent Application No. PCt/US12/038660, 11 pages.
Fischer, Perry A. et al; Expandable Technology Developments Zero in on Practical Applications; World Oil Online; vol. 226 No. 7; Retrieved on Aug. 2, 2011 from http//www.worldoil.com/July-2005-Expandable-technology-developments-zero-in-on-practical-applications.html; 11 pages.
Erivwo, Ochuko et al; Level 6 Multi-Lateral Experiences in the Niger Delta—A Review; SPE 90423; Sep. 2004; 13 pages.
W. Standifird et al.; "Real-Time Basin Modeling: Improving Geopressure and Earth-Stress Predictions", SPE 96464, dated Sep. 6-9, 2005, 6 pages.
W. Standifird et al.; "New Data Transmission Standard Facilitates Synchronous Remote Modeling and Surveillance via the Internet", SPE 99466, dated Apr. 11-13, 2006, 9 pages.
John Jones, et al; "Novel Approach for Estimating Pore Fluid Pressures Ahead of the Drill Bit", SPE/IADC 104606, dated Feb. 20-22, 2007, 13 pages.
Leg Support Device photograph; entitled 449S0733-Dual, dated Feb. 23, 1998, 1 page.
Leg Support Device photograph; entitled 449S0733-Dual-2, dated Feb. 25, 1998, 1 page.
Leg Support Device photograph; entitled 449S0733-Dual-Closeup, dated Apr. 14, 1998, 1 page.
Leg Support Device drawing; 44950733-Model, created Dec. 16, 1997, 1 page.
Baker Hughes; "Case Hole Applications", product and systems catalog, dated 2010, 94 pages.
Collins, Gary; Bennett, Rod; "Two Wells Drilled From One Surface Bore with Downhole Splitter. (Oil Well Drilling Technology)", The Oil and Gas Journal, online article from accessmylibrary.com, dated Oct. 3, 1994, 5 pages.
Boggs, Robert N.; "Splitter Puts Two Wells in One Wellhead", DesignNews Blog, dated Mar. 27, 1995, 1 page.
Halliburton; "Developing the Heavy Oil and Oil Sands Assets", article H06153, dated Mar. 2008, 46 pages.
Perdue, Jeanne M.; "Level 5 and 6 Junctions Really Function", E&P magazine online article, dated May 1, 2001, 3 pages.
Halliburton; "SperryRite Advanced Reservoir Drainage Services: FloRite Multi-string Multilateral Completion System Multilateral Completion Systems", article H02583-A4, dated Sep. 2007, 2 pages.
Halliburton; "Multilateral Solutions: SperryRite Advanced Reservoir Drainage Services", product article, retrieved Jul. 20, 2011, 6 pages.
Schlumberger; "RapidX: TAML 5 Multilateral Junction", product sheet, dated 2009, 2 pages.
Schlumberger; "RapidX: TAML 5 Multilateral Junction", online product page, dated 2009, 1 page.
Halliburton; "SperryRite Advanced Reservoir Drainage Services", article H06637, dated Jan. 2009, 2 pages.
Halliburton, "FloRite Multi-string Multilateral Completion System", H02583, Sep. 2007, 2 pages.
Halliburton, "SealRite Sealed Multilateral System", H06637, Jan. 2009, 2 pages.
Office Action issued Oct. 3, 2013 for U.S. Appl. No. 13/781,570, 23 pages.
Office Action issued Jun. 13, 2013 for U.S. Appl. No. 13/152,892, 8 pages.
Office Action issued Apr. 11, 2014 for U.S. Appl. No. 13/781,570, 30 pages.
International Search Report and Written Opinion issued Jan. 30, 2013 for PCT Patent Application No. PCT/US2012/037493, 11 pages.

* cited by examiner

VARIABLY CONFIGURABLE WELLBORE JUNCTION ASSEMBLY

BACKGROUND

This disclosure relates generally to equipment utilized and operations performed in conjunction with a subterranean well and, in an example described below, more particularly provides a variably configurable junction assembly for a branched wellbore.

A wellbore junction provides for connectivity in a branched or multilateral wellbore. Such connectivity can include sealed fluid communication and/or access between certain wellbore sections.

Unfortunately, a typical wellbore junction's configuration (e.g., sealed fluid communication and/or access between certain wellbore sections) cannot be changed to suit particular well circumstances. Therefore, it will be appreciated that improvements would be beneficial in the art of configuring wellbore junction assemblies.

SUMMARY

In the disclosure below, apparatus and methods are provided which bring improvements to the art of configuring wellbore junction assemblies. One example is described below in which a wellbore junction assembly can be selectively configured to permit access to one or another of multiple tubular strings connected to a connector. Another example is described below in which oriented connections are used for interchangeably connecting the tubular strings to the connector.

In one aspect, the disclosure below describes a method of installing a wellbore junction assembly in a well. The method can include connecting at least two tubular strings to one opposite end of a tubular string connector with similarly dimensioned oriented connections, whereby the tubular strings are interchangeably connectable to the connector with the oriented connections.

In another aspect, this disclosure provides to the art a wellbore junction assembly. The assembly can include at least two tubular strings and a tubular string connector having opposite ends. Each of the tubular strings may be secured to one opposite end of the connector by oriented connections, whereby each of the tubular strings has a fixed rotational orientation relative to the connector.

In yet another aspect, a well system described below can include a tubular string connector, multiple tubular strings secured to the connector, and a support which reduces bending of one of the tubular strings which results from deflection of the tubular string from one wellbore section into another wellbore section.

In a further aspect, a well system is provided to the art which can include a tubular string connector having first and second opposite ends, first and second tubular strings secured to the first opposite end, the first and second tubular strings being disposed in separate intersecting wellbore sections, third and fourth tubular strings secured to the second opposite end, the fourth tubular string being disposed within the third tubular string, a first flow control device which selectively permits and prevents fluid flow through a longitudinal flow passage of the third tubular string, and a second flow control device which selectively permits and prevents fluid flow through a longitudinal flow passage of the fourth tubular string.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
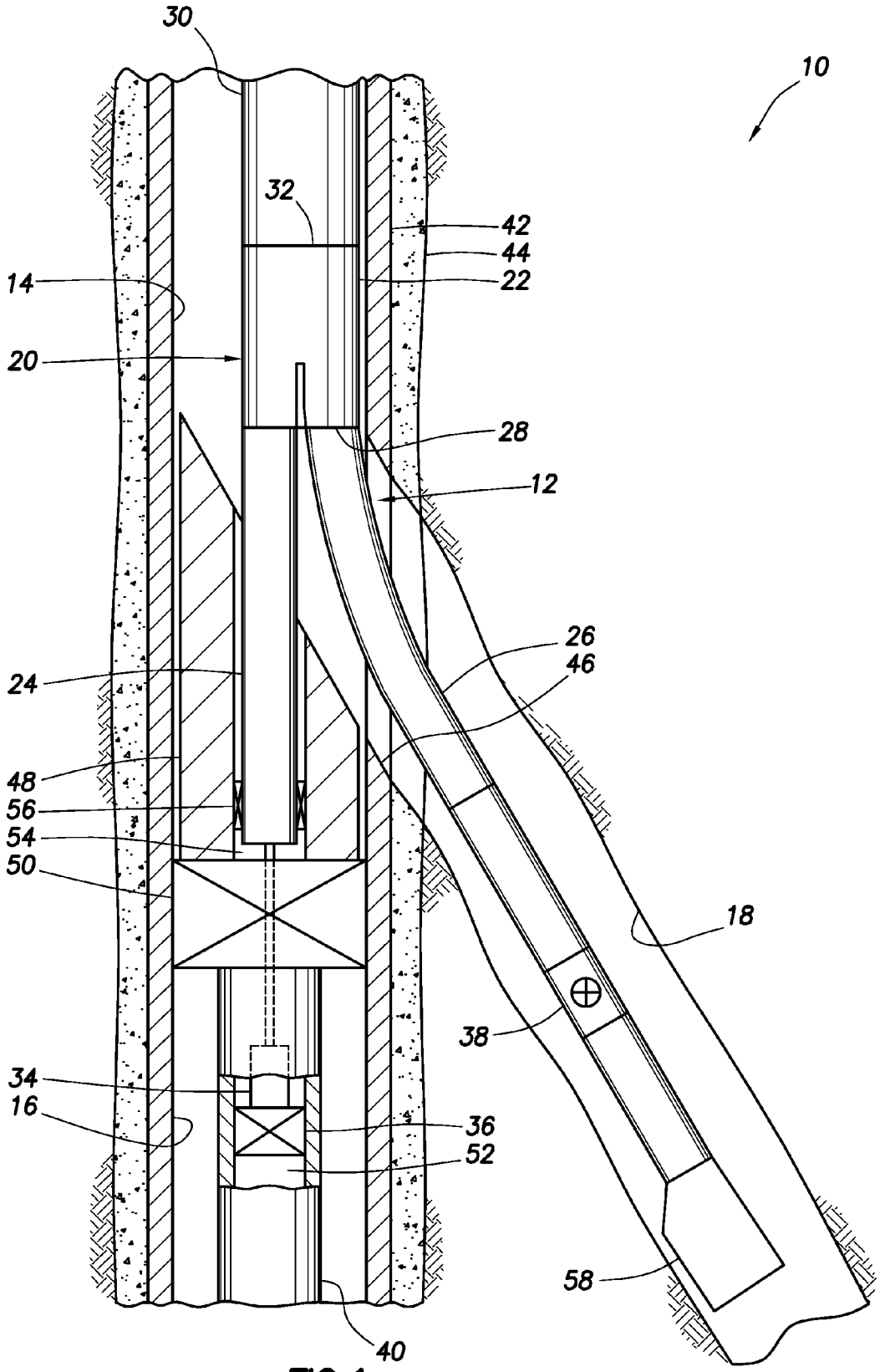
FIG. 1 is a representative partially cross-sectional view of a well system and associated method which can embody principles of this disclosure.

Representatively illustrated in FIG. 1 is a well system 10 and associated method which can embody principles of this disclosure. In the well system 10, a wellbore junction 12 is formed at an intersection of three wellbore sections 14, 16, 18.

In this example, the wellbore sections 14, 16 are part of a "parent" or main wellbore, and the wellbore section 18 is a "lateral" or branch wellbore extending outwardly from the main wellbore. In other examples, the wellbore sections 14, 18 could form a main wellbore, and the wellbore section 16 could be a branch wellbore. In further examples, more than three wellbore sections could intersect at the wellbore junction 12, the wellbore sections 16, 18 could both be branches of the wellbore section 14, etc. Thus, it should be understood that the principles of this disclosure are not limited at all to the particular configuration of the well system 10 and wellbore junction 12 depicted in FIG. 1 and described herein.

In one unique feature of the well system 10, a wellbore junction assembly 20 is installed in the wellbore sections 14, 16, 18 to provide controlled fluid communication and access between the wellbore sections. The assembly 20 includes a tubular string connector 22, tubular strings 24, 26 attached to an end 28 of the connector, and a tubular string 30 attached to an opposite end 32 of the connector.

In this example, the connector 22 provides sealed fluid communication between the tubular string 30 and each of the tubular strings 24, 26. In addition, physical access is provided through the connector 22 between the tubular string 30 and one of the tubular strings 24, 26. The tubular string 24 or 26 to which access is provided is determined by connecting the tubular strings to certain respective ones of oriented connections, as described more fully below.

Such access can allow a well tool 34 (such as a shifting tool, running tool, retrieving tool, etc.) to be conveyed through the connector 22 and into one of the tubular strings 24, 26, for example, to operate a valve or other flow control device 36 which controls flow longitudinally through a tubular string 40 in the wellbore section 16, or to operate a valve or other flow control device 38 which controls flow between the wellbore 18 and an interior of the tubular string 26, etc. Access through the connector 22 may be used for purposes other than operating flow control devices, in keeping with the scope of this disclosure.

In the example depicted in FIG. 1, the wellbore sections 14, 16 are lined with casing 42 and cement 44, but the wellbore section 18 is uncased or open hole. A window 46 is formed through the casing 42 and cement 44, with the wellbore section 18 extending outwardly from the window.

However, other completion methods and configurations may be used, if desired. For example, the wellbore section 18 could be lined, with a liner therein being sealingly connected to the window 46 or other portion of the casing 42, etc. Thus, it will be appreciated that the scope of this disclosure is not limited to any of the features of the well system 10 or the associated method described herein or depicted in the drawings.

A deflector 48 is secured in the casing 42 at the junction 12 by a packer, latch or other anchor 50. The tubular string 40 is sealingly secured to the anchor 50 and deflector 48, so that a passage 52 in the tubular string 40 is in communication with a passage 54 in the deflector 48. The tubular string 24 is engaged with seals 56 in the deflector 48, so that the tubular string 24 is in sealed communication with the tubular string 40 in the wellbore section 16.

A bull nose 58 on a lower end of the tubular string 26 is too large to fit into the passage 54 in the deflector 48 and so, when the junction assembly 20 is lowered into the well, the bull nose 58 is deflected laterally into the wellbore section 18. The tubular string 24, however, is able to fit into the passage 54 and, when the junction assembly 20 is appropriately positioned as depicted in FIG. 1, the tubular string 24 will be in sealed communication with the tubular string 40 via the passage 54.

In the example of FIG. 1, fluids (such as hydrocarbon fluids, oil, gas, water, steam, etc.) can be produced from the wellbore sections 16, 18 via the respective tubular strings 24, 26. The fluids can flow via the connector 22 into the tubular string 30 for eventual production to the surface.

However, such production is not necessary in keeping with the scope of this disclosure. In other examples, fluid (such as steam, liquid water, gas, etc.) could be injected into one of the wellbore sections 16, 18 and another fluid (such as oil and/or gas, etc.) could be produced from the other wellbore section, fluids could be injected into both of the wellbore sections 16, 18, etc. Thus, any type of injection and/or production operations can be performed in keeping with the principles of this disclosure.

Figure 2:
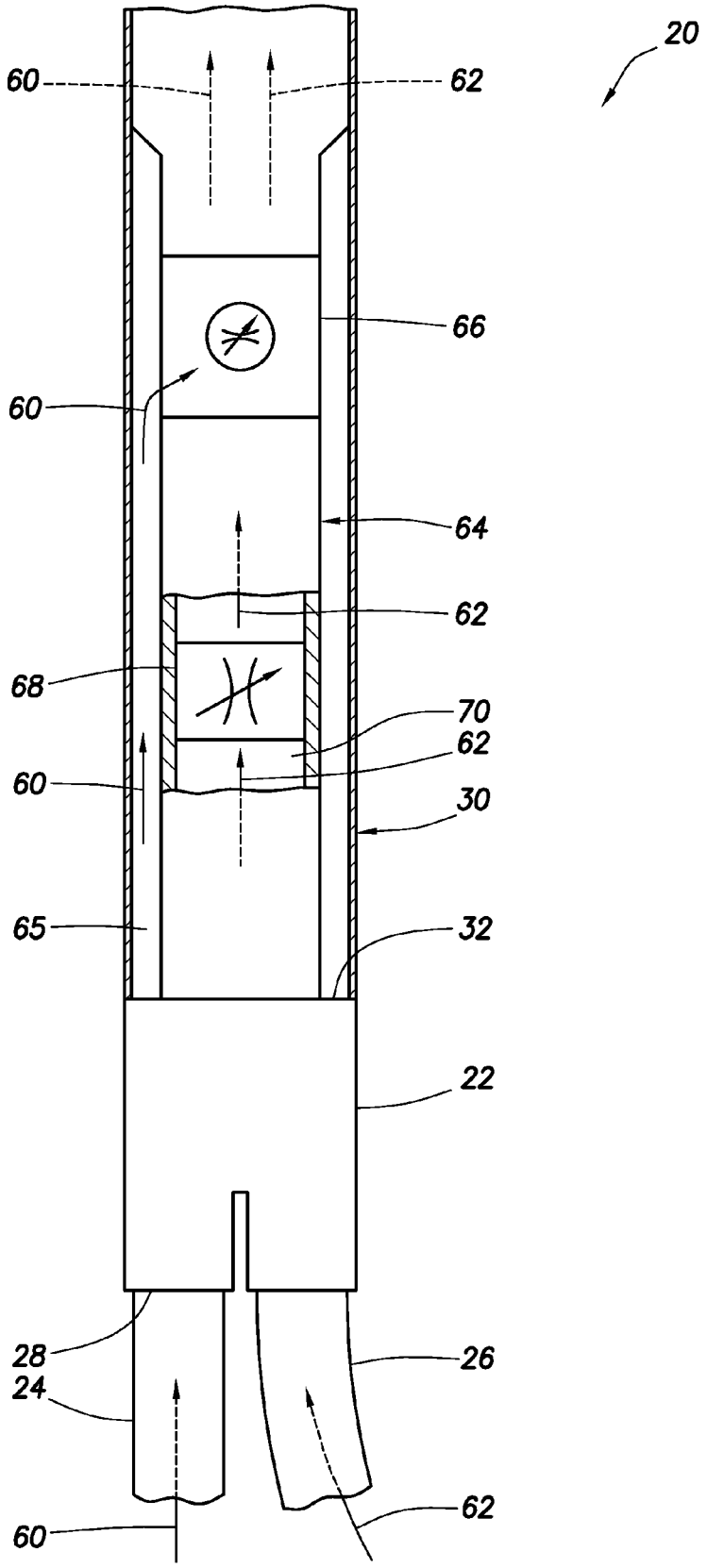
FIG. 2 is a representative partially cross-sectional view of a wellbore junction assembly which may be used in the system and method of FIG. 1, and which can embody principles of this disclosure.

Referring additionally now to FIG. 2, a partially cross-sectional view of the wellbore junction assembly 20 is representatively illustrated, apart from the remainder of the system 10. In this example, a fluid 60 is produced from the wellbore section 16 via the tubular string 24 to the connector 22, and another fluid 62 is produced from the wellbore section 18 via the tubular string 26 to the connector. The fluids 60, 62 may be the same type of fluid (e.g., oil, gas, steam, water, etc.), or they may be different types of fluids.

The fluid 62 flows via the connector 22 into another tubular string 64 positioned within the tubular string 30. The fluid 60 flows via the connector 22 into a space 65 formed radially between the tubular strings 30, 64.

Chokes or other types of flow control devices 66, 68 can be used to variably regulate the flows of the fluids 60, 62 into the tubular string 30 above the tubular string 64. The devices 66, 68 may be remotely controllable by wired or wireless means (e.g., by acoustic, pressure pulse or electromagnetic telemetry, by optical waveguide, electrical conductor or control lines, etc.), allowing for an intelligent completion in which production from the various wellbore sections can be independently controlled.

Although the fluids 60, 62 are depicted in FIG. 2 as being commingled in the tubular string 30 above the tubular string 64, it will be appreciated that the fluids could remain segregated in other examples. In addition, although the device 68 is illustrated as possibly obstructing a passage 70 through the tubular string 64, in other examples the device 68 could be positioned so that it effectively regulates flow of the fluid 62 without obstructing the passage.

In one example, physical access is provided between the passage 70 and the interior of the tubular string 26 (as depicted in FIG. 2), or the interior of the tubular string 24, depending on how the tubular strings 24, 26 are connected to the connector 22. Thus, an item of equipment (such as the well tool 34) can pass from the tubular string 30 into the tubular string 64, through the passage 70 to the connector 22, and via the connector into the tubular string 26, or into the tubular string 24.

Figure 3:
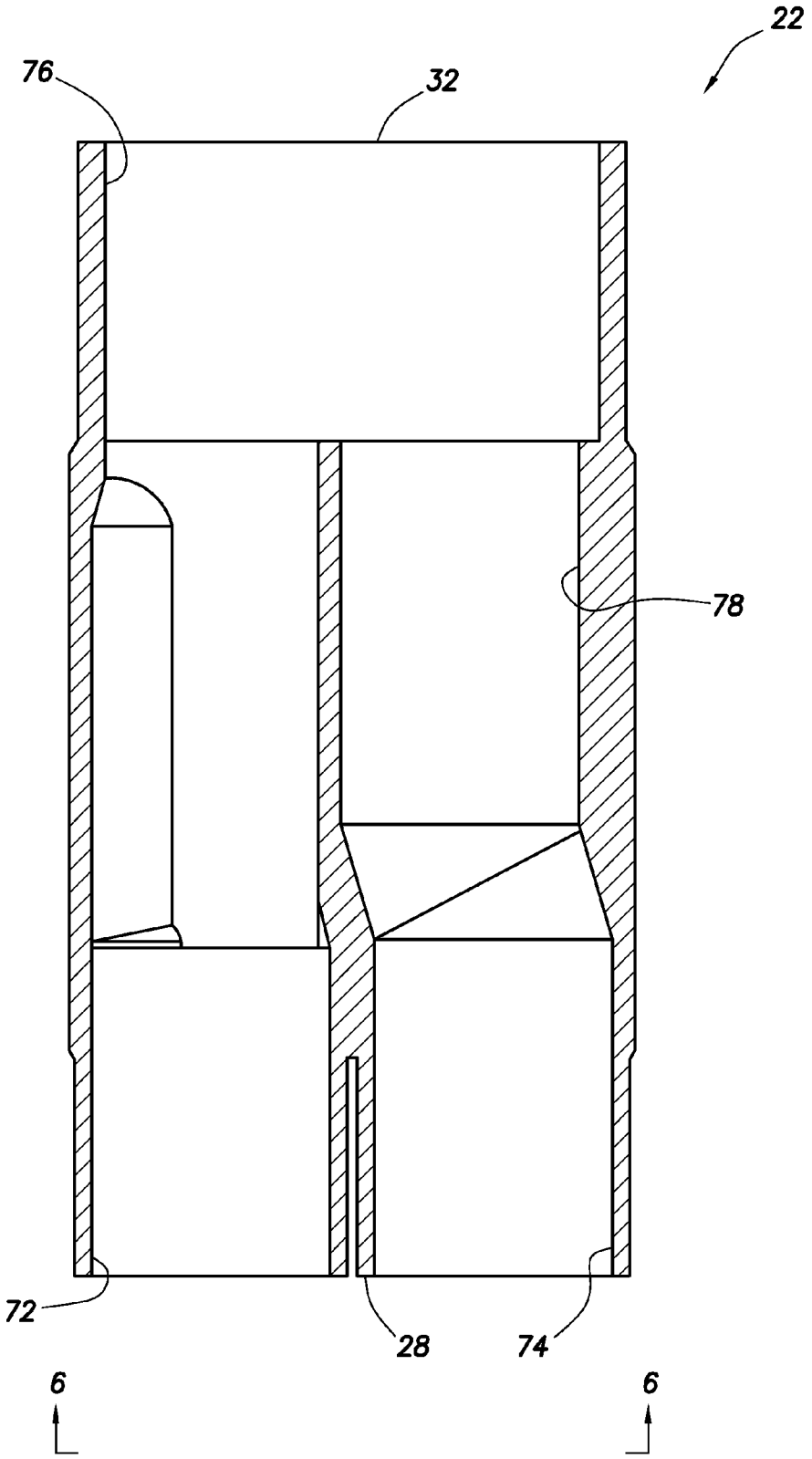
FIG. 3 is a representative cross-sectional view of a tubular string connector which may be used in the wellbore junction assembly of FIG. 2, and which can embody principles of this disclosure.

Referring additionally now to FIG. 3, an enlarged scale cross-sectional view of the tubular string connector 22 is representatively illustrated. In this view, it may be seen that the connector 22 is provided with connections 72, 74 at one end 28, and connections 76, 78 at the opposite end 32.

The tubular strings 24, 26 are connected to the connector 22 by the connections 72, 74. The tubular strings 30, 64 are connected to the connector 22 by the respective connections 76, 78. Preferably, each of the connections 72, 74, 76, 78 in this example comprises an internal thread in the connector 22, but other types of connections may be used, if desired.

The connections 72, 74 are preferably of the type known to those skilled in the art as premium oriented threads. One suitable oriented thread is the VAM™ "FJL" oriented thread, although other oriented threads and other types of oriented connections may be used and remain within the scope of this disclosure. Other types of oriented connections could include J-slots, etc.

The oriented connections 72, 74 fix a rotational orientation of each of the tubular strings 24, 26 relative to the connector 22. In addition, if the oriented connections 72, 74 are identically (or at least similarly) dimensioned, then each of the tubular strings 24, 26 can be connected to the connector 22 by either one of the oriented connections.

The dimensions of the connections 72, 74 are similar if this interchangeability of the tubular strings 24, 26 is permitted. Thus, one of the connections 72, 74 could be somewhat different from the other of the connections, and yet the connections 72, 74 can still be similarly dimensioned, if each tubular string 24, 26 can be operatively connected to the connector 22 by either one of the connections.

When used in the wellbore junction assembly 20 of FIGS. 1 & 2, the tubular string 64 could be connected to the connection 78, for example, by threading. The connection 78 may comprise an oriented connection, if desired. The tubular string 30 could be connected to the connection 76, for example, by threading. The connection 76 may comprise an oriented connection, if desired.

With the tubular string 64 connected to the connection 78, physical access is provided between the interior of the tubular string 64 and the interior of the tubular string 24 or 26 connected to the connection 74. In the example of FIG. 1, the well tool 34 can be conveyed through the tubular string 30 to the top of the tubular string 64, through the tubular string 64 to the connector 22, and through the connector into the tubular string 24.

In this example, the tubular string 24 would be connected to the connector 22 via the connection 74. Alternatively, the tubular string 26 could be connected to the connector 22 via the connection 74, in which case the well tool 34 could be conveyed from the tubular string 30 into the tubular string 64, and through the connector into the tubular string 26 (for example, to operate the flow control device 38).

The choice of which of the tubular strings 24, 26 can be physically accessed through the connector 22 is made prior to installing the junction assembly 20 in the well. The use of the similarly dimensioned connections 72, 74 ensures that the tubular string 24 can be connected to the connector 22 by either one of the connections, and the tubular string 26 can be connected to the connector by the other one of the connections.

Furthermore, the use of the oriented connections 72, 74 ensures that the tubular strings 24, 26 will be properly rotationally oriented relative to the connector 22 when the tubular strings are connected. This feature is beneficial, for example, so that the bull nose 58 is properly rotationally oriented for deflection into the wellbore section 18 by the deflector 48, etc.

Preferably, all threaded connections between the bull nose 58 and the connector 22 are oriented connections, so that the bull nose is properly rotationally aligned to deflect laterally off of the deflector 48 when all of the threaded connections are made up. Alternatively, all of the components of the tubular string 26, except for the bull nose 58, could be made up, then upper threads on the bull nose could be cut so that, when the bull nose is made up to the rest of the tubular string, the bull nose will be properly rotationally aligned.

Yet another alternative is to make up all of the components of the tubular string 26, other than the bull nose 58 and a pup joint (relatively short tubular section) above the bull nose. Then, the pup joint (for example, a pup joint between the device 38 and the bull nose 58) could be selected or custom machined (e.g., with a chosen rotational offset between its ends), so that when the pup joint and bull nose are assembled to the remainder of the tubular string 26, the bull nose will be properly rotationally oriented to deflect laterally off of the deflector 48. The pup joint could be provided with oriented threads at either or both of its ends.

Referring additionally now to FIGS. 4A-G, selected axial sections of the junction assembly 20 are representatively illustrated in more detailed cross-sectional views. The junction assembly 20 may be used in the well system 10 and method of FIG. 1, or it may be used in other systems and methods, in keeping with the principles of this disclosure.

Note that, instead of being connected at a lower end of the tubular string 26, the bull nose 58 depicted in FIG. 1 may be used to transition between a smaller diameter upper section of the tubular string and a larger diameter lower section of the tubular string. The larger diameter lower section of the tubular string 26 could include various components, e.g., completion components such as sand screens, packers, plugs, liner, valves, chokes, seal assemblies (for example, to sting into a liner string previously installed in the wellbore section 18, etc.), control lines (for example, to operate valves, chokes, etc.), etc. A lower end of the tubular string 26 could include another component which deflects laterally off of the deflector 48 (similar to the bull nose 58). The device 38 could be connected in either of the smaller or larger diameter sections of the tubular string 26 in that case.

Figure 4A:
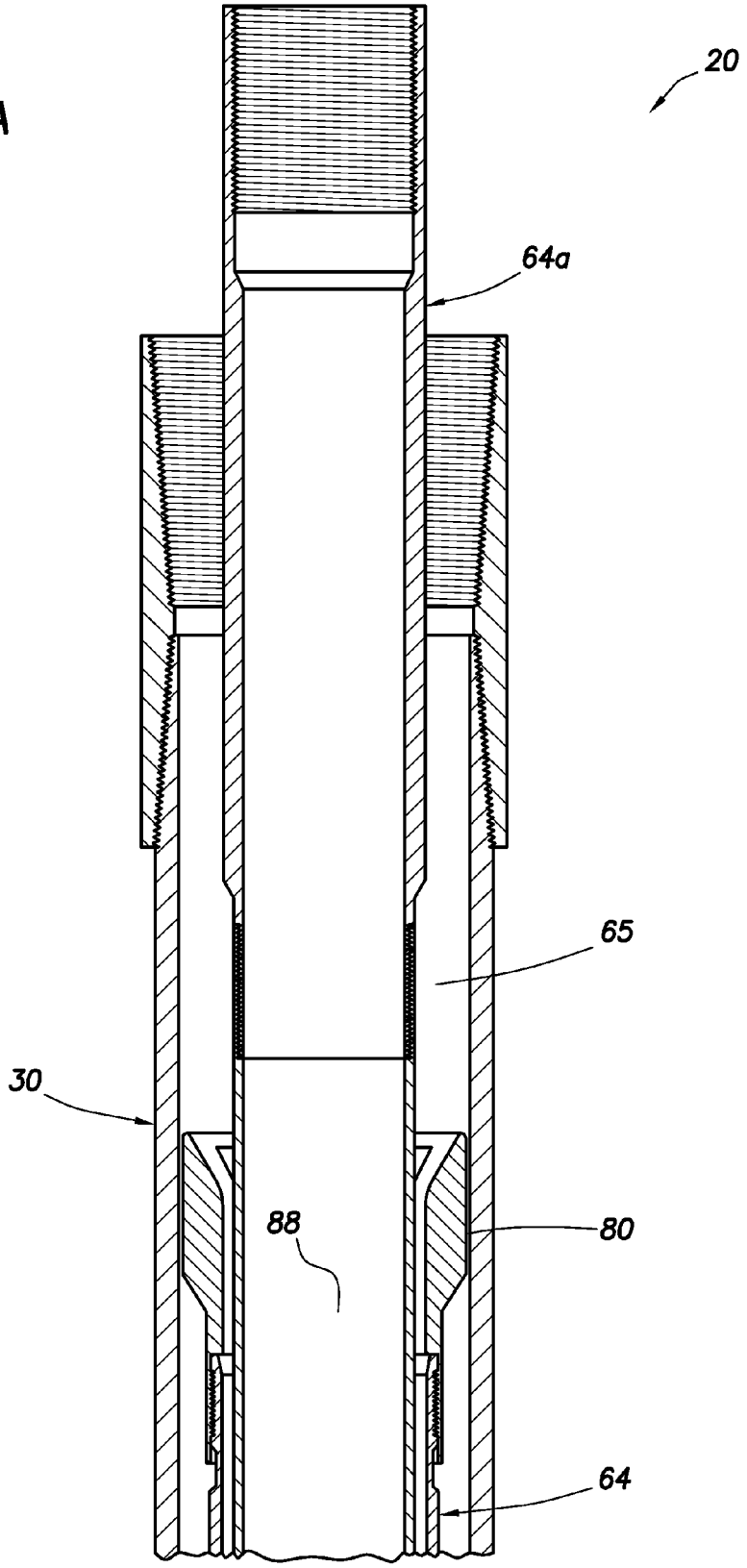
FIGS. 4A-G are representative cross-sectional detailed views of axial sections of the wellbore junction assembly.

In FIG. 4A, it may be seen that the tubular string 64 is positioned within the tubular string 30. Another tubular string (indicated as 64*a* in FIG. 4A) is sealingly installed in the tubular string 64 and effectively becomes a part thereof. An upper "scoop head" 80 is provided on the tubular string 64 for convenient insertion of the tubular string 64*a* therein while the junction assembly 20 is in the well.

In this example, the flow control devices 66, 68 of FIG. 2 can be interconnected in the tubular string 64*a*. Thus, the tubular string 64*a*, along with the flow control devices 66, 68 and other equipment (e.g., telemetry devices, lines, etc.) can be installed in the junction assembly 20 after the junction assembly has been installed in the well at the wellbore junction 12. Furthermore, the tubular string 64*a*, along with the flow control devices 66, 68 and other equipment, can be conveniently retrieved (e.g., for maintenance, repair, replacement, etc.) from the junction assembly 20, if desired.

Figure 4B:
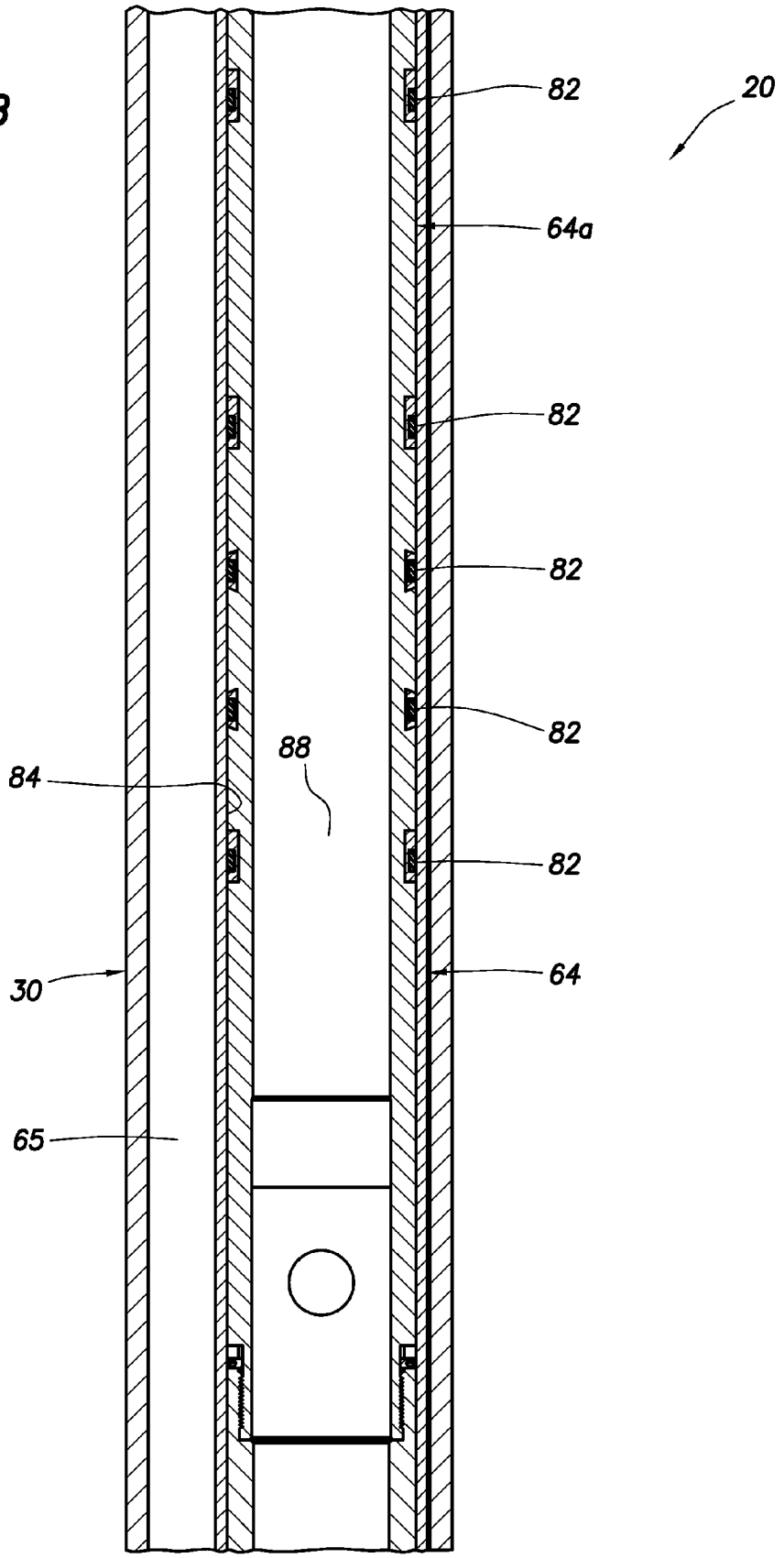

In FIG. 4B, it may be seen that seals 82 carried on the tubular string 64*a* sealingly engage a seal bore 84 formed in the tubular string 64. Engagement of the seals 82 in the seal bore 84 provides for sealed fluid communication between an internal passage 86 of the tubular string 64 and an internal passage 88 of the tubular string 64*a*. Together, the passages 86, 88 can comprise the passage 70 depicted in FIG. 2.

Figure 4C:
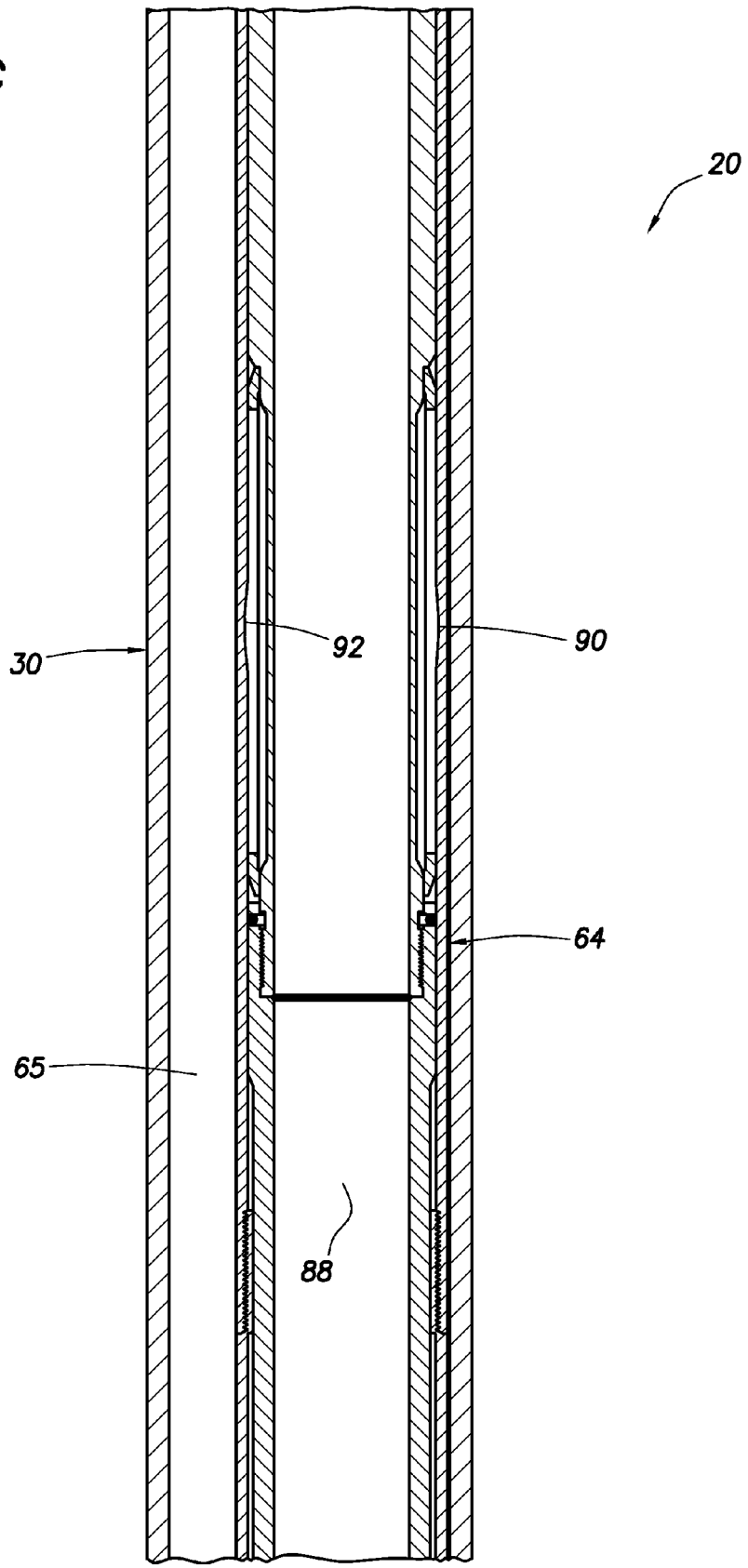

In FIG. 4C, it may be seen that a latch 90 carried on the tubular string 64*a* releasably engages an internal profile 92 formed in the tubular string 64. In this manner, the tubular string 64*a* is releasably secured in the tubular string 64. The seal bore 84 and profile 92 may be the same as, or similar to, the type used on conventional polished bore receptacles well known to those skilled in the art.

Figure 4D:
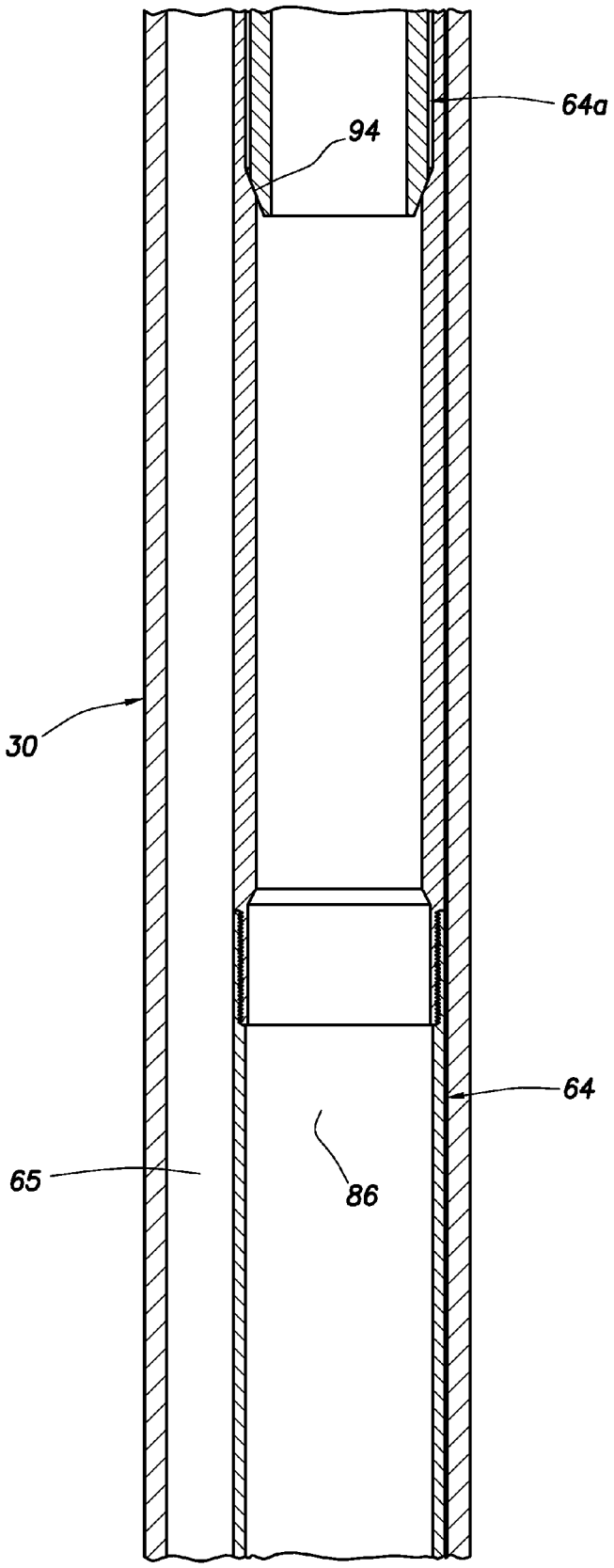

In FIG. 4D, it may be seen that a lower end of the tubular string 64*a* engages a shoulder 94 formed in the tubular string 64. This engagement with the shoulder 94 properly positions the tubular string 64*a* relative to the tubular string 64.

Figure 4E:
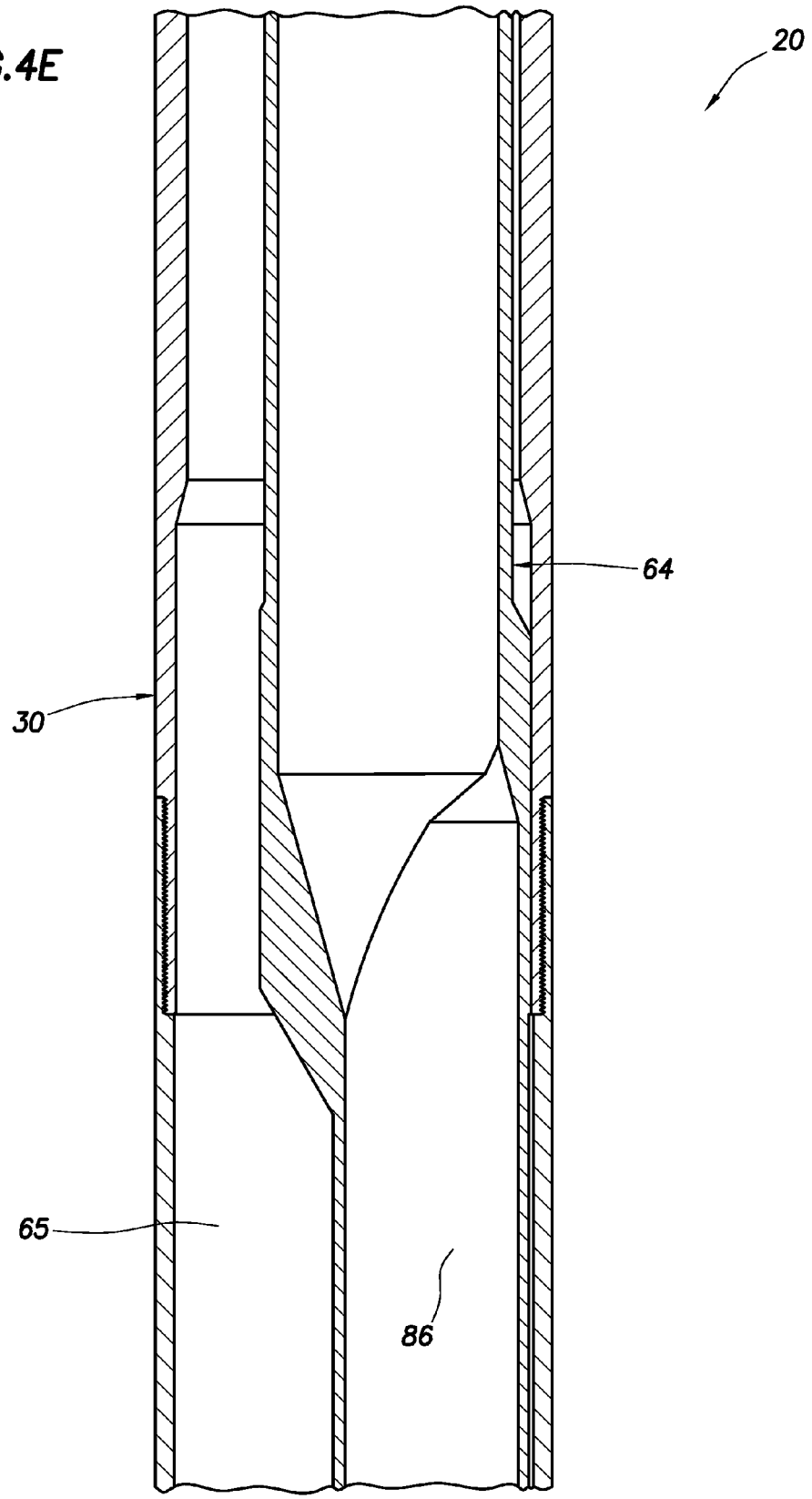

In FIG. 4E, it may be seen that the passage 86 is laterally offset in the tubular string 64. This lateral offset is optional (as are the other features of the junction assembly 20 described herein and depicted in the drawings), but in this example the offset accommodates a change in wall thickness of the outer tubular string 30, and positions the tubular string 64 more toward a center of the outer tubular string. The scoop head 80 (see FIG. 4A) is used to more closely center the top of the tubular string 64 in the tubular string 30.

Figure 4F:
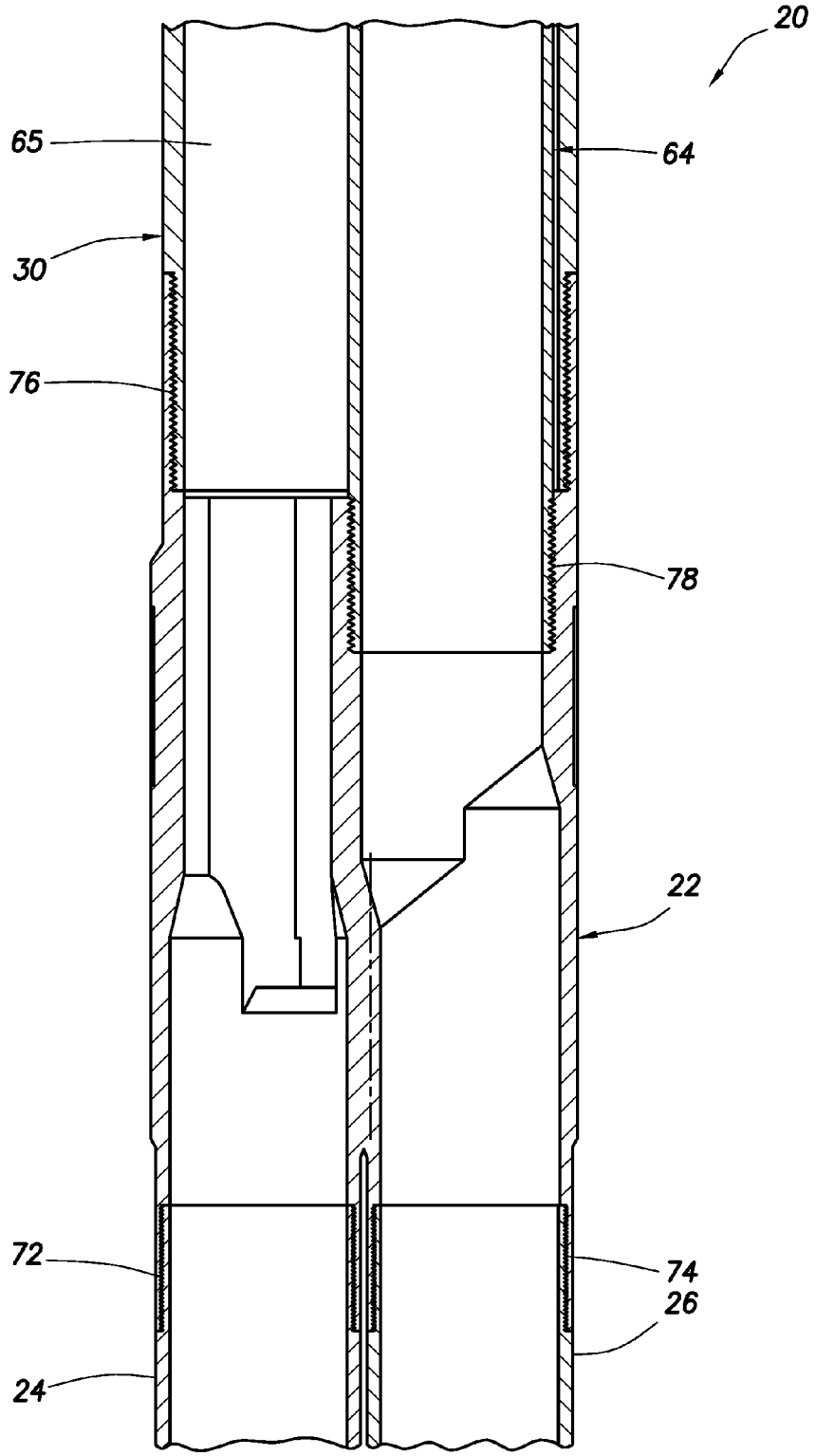

In FIG. 4F, it may be seen that the tubular string 64 is connected to the connector 22 via the connection 78. The tubular string 30 is connected to the connector 22 via the connection 76. The tubular string 24 is connected via the connection 72, and the tubular string 26 is connected via the connection 74. Thus, in this example, physical access is provided between the tubular string 64 and the tubular string 26 through the connector 22.

Figure 4G:
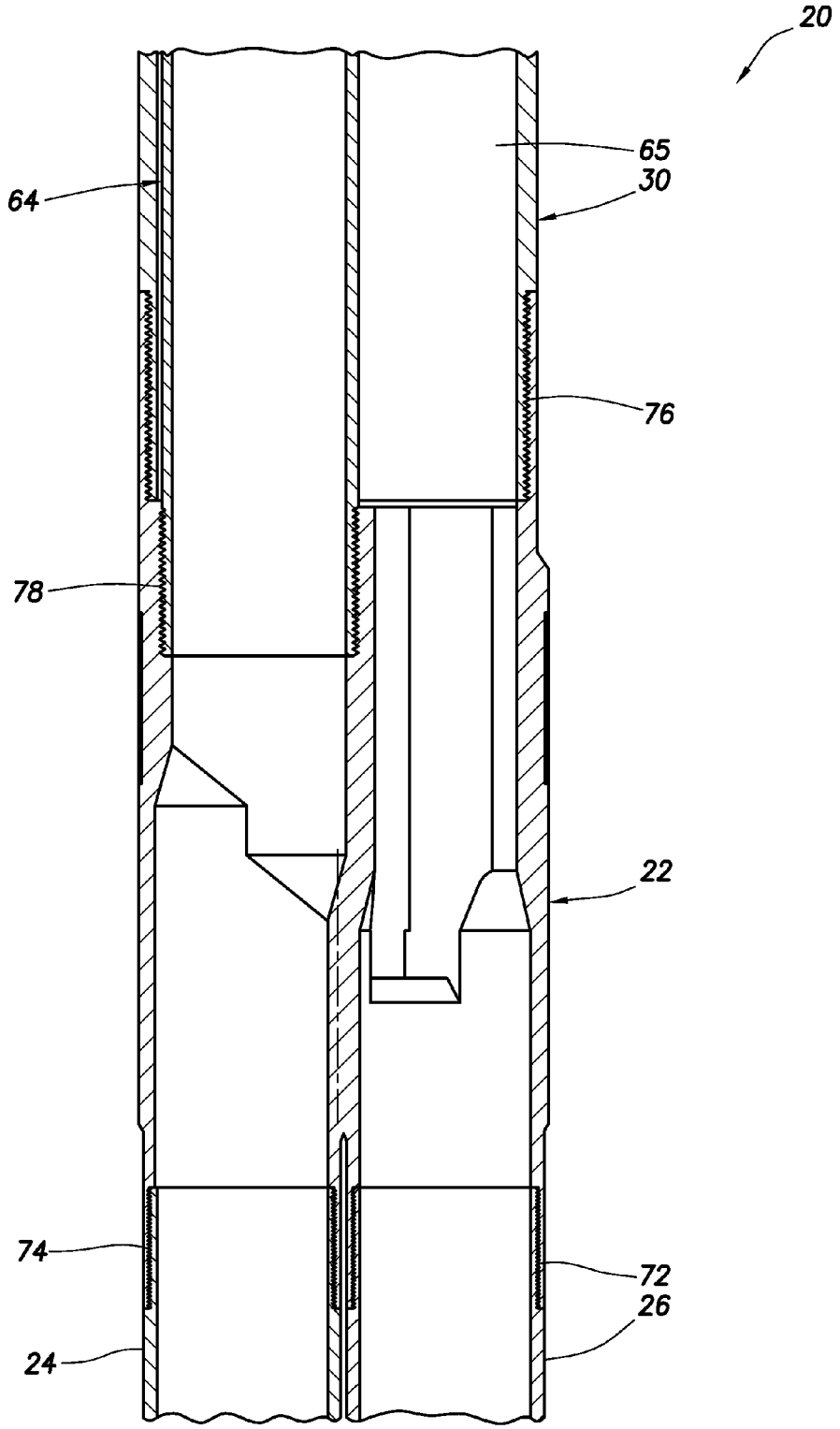
Figure 5A:
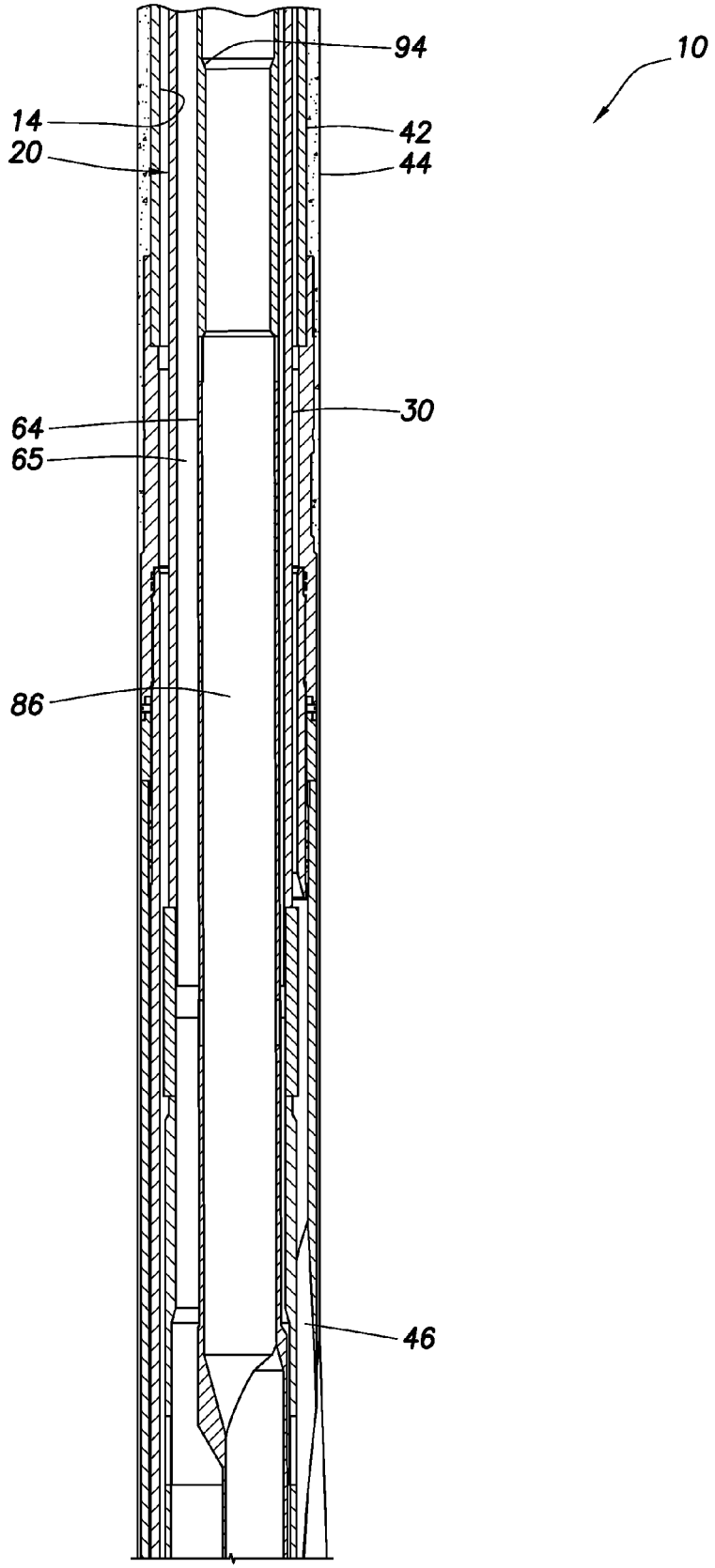
FIGS. 5A-E are representative cross-sectional detailed views of the wellbore junction assembly installed in a branched wellbore.
Figure 5B:
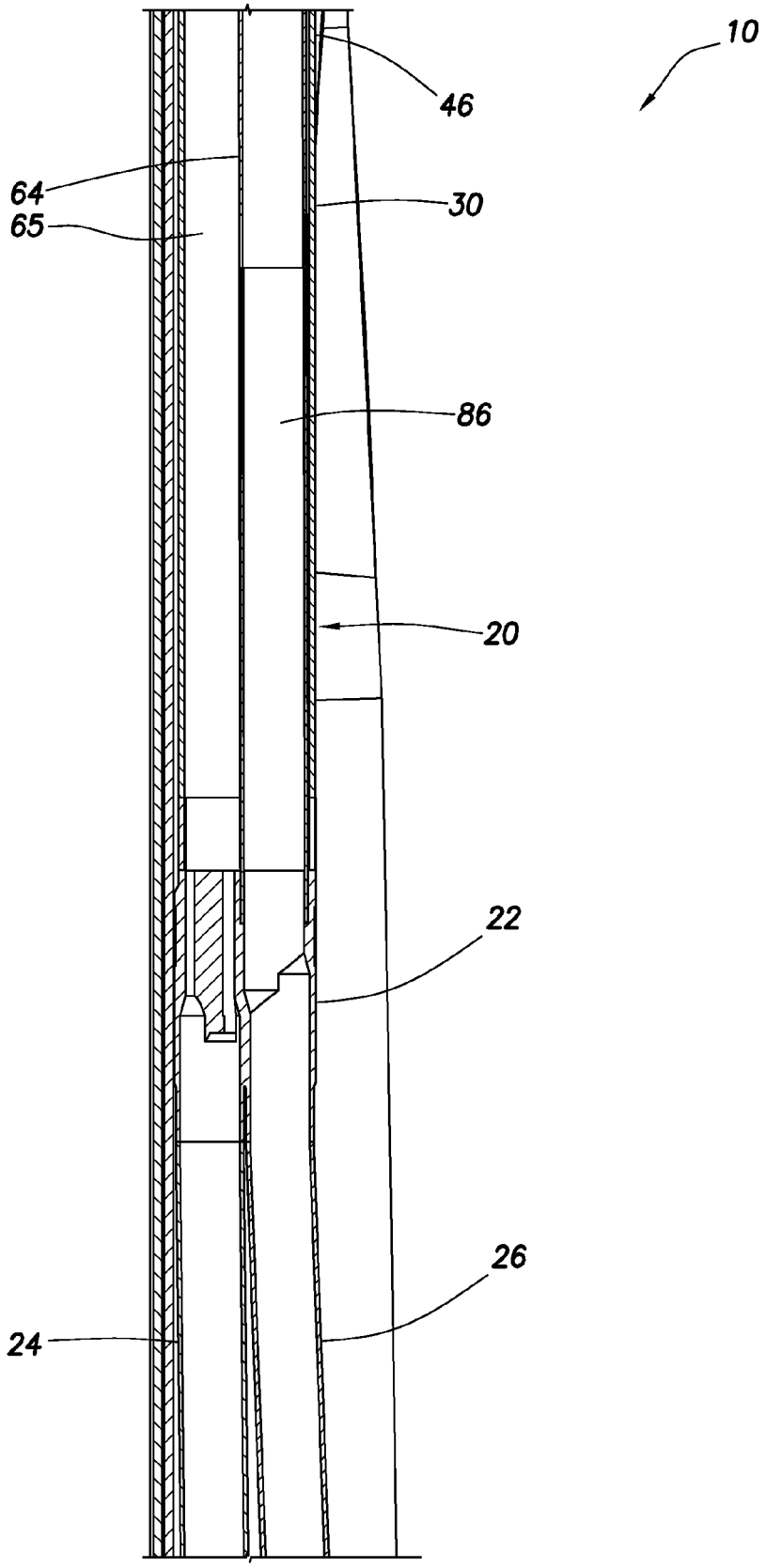
Figure 5C:
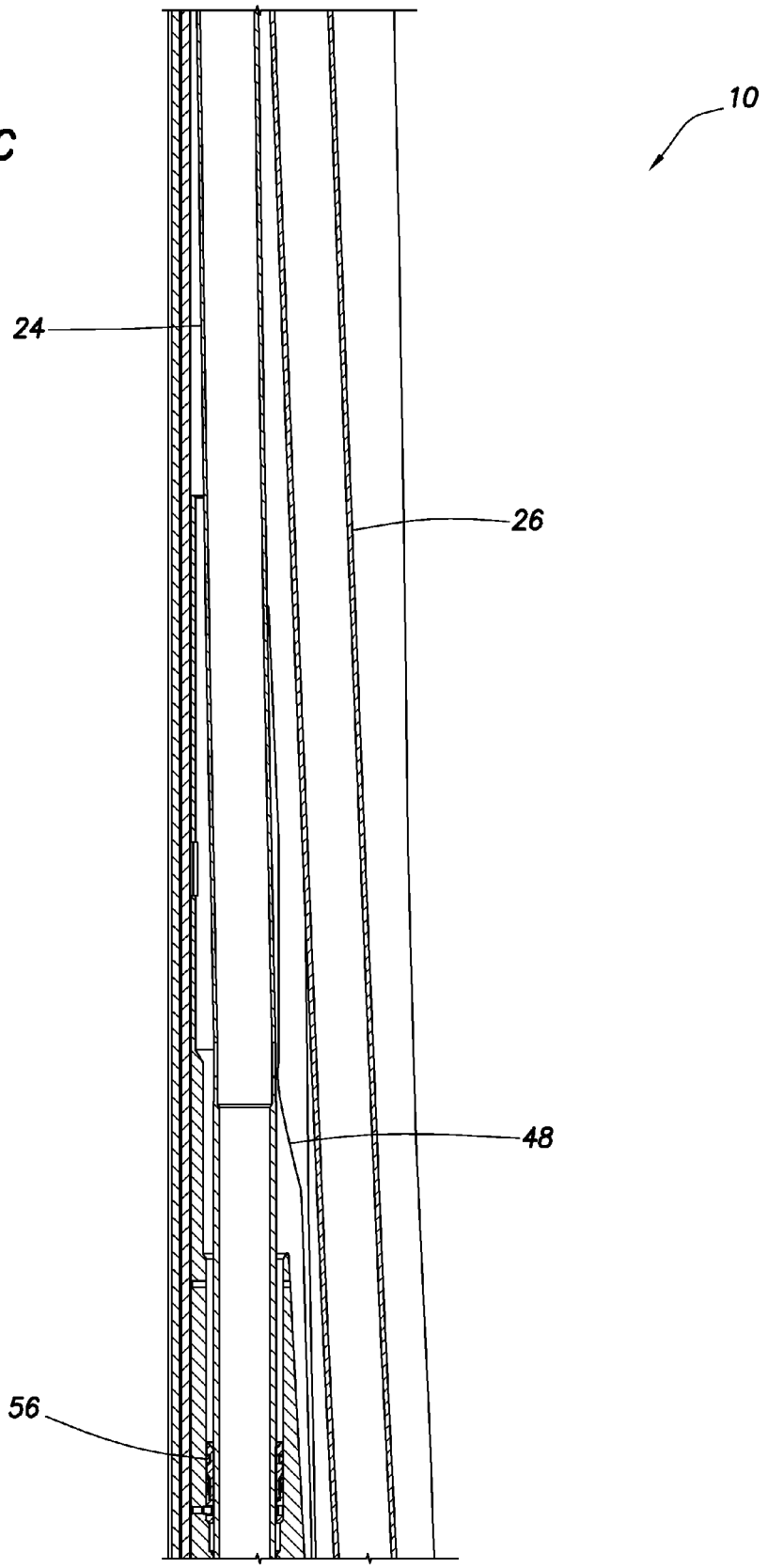
Figure 5D:
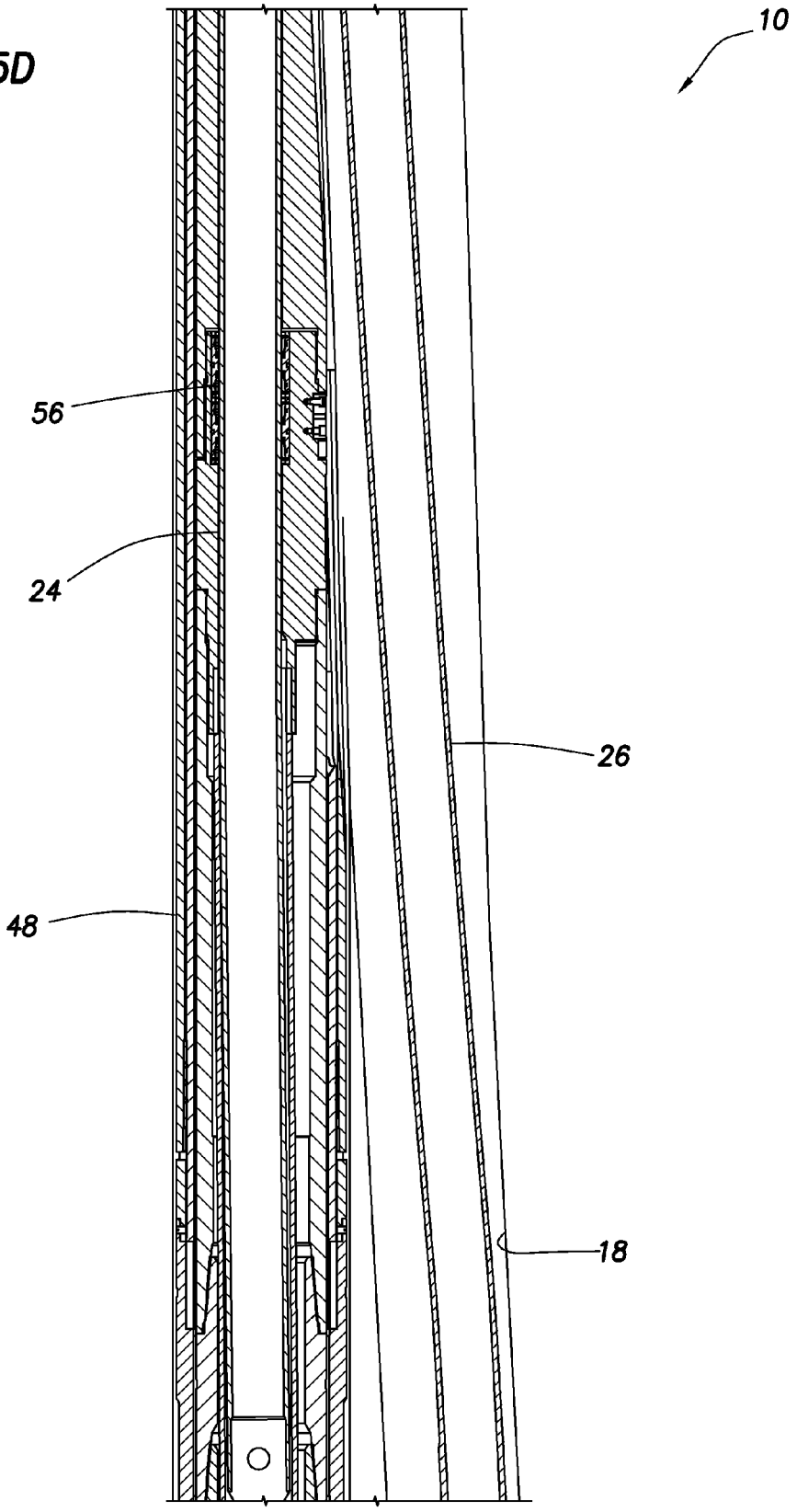
Figure 5E:
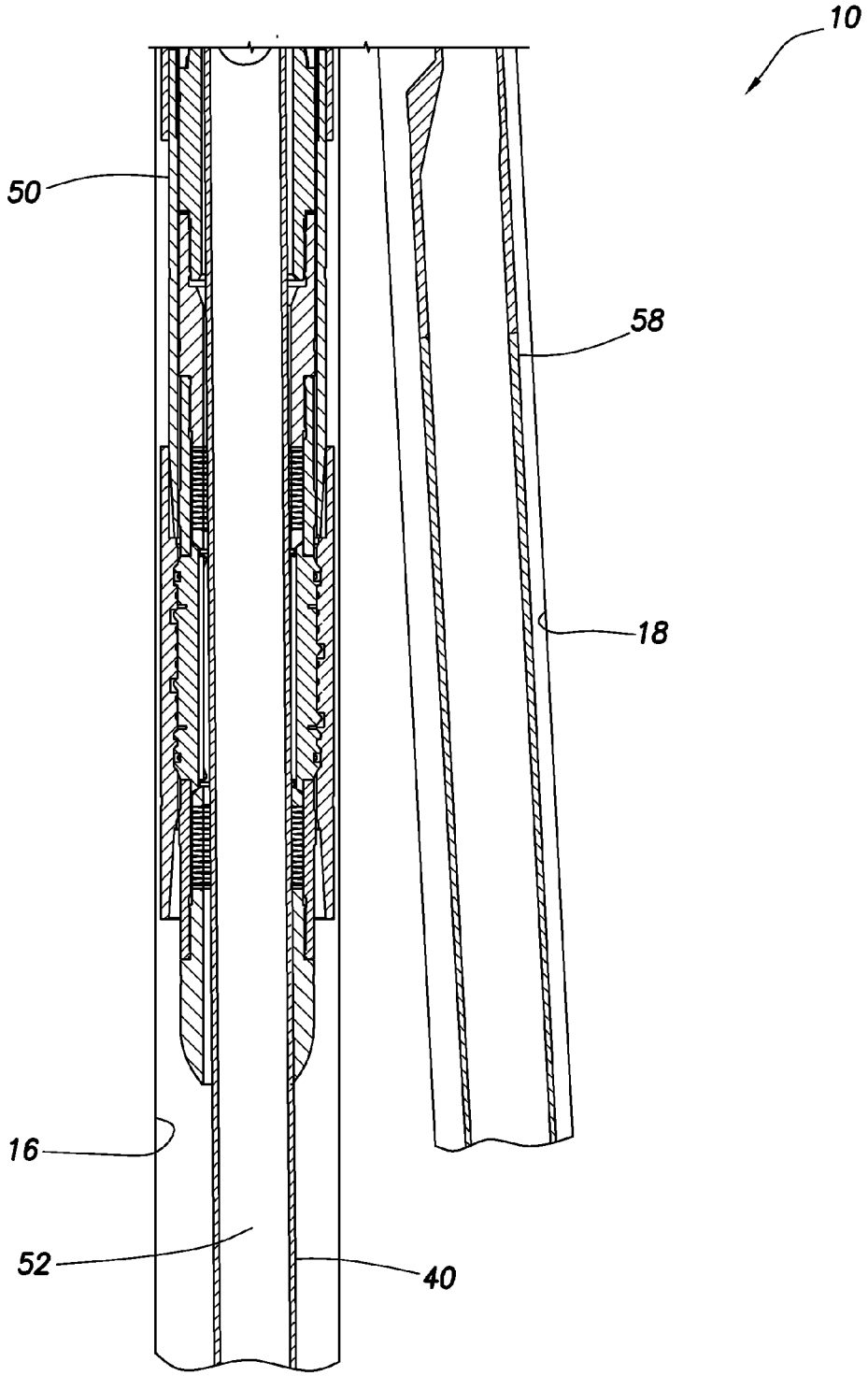

In FIG. 4G, the configuration of the junction assembly 20 is changed somewhat, in that the tubular string 24 (instead of the tubular string 26) is connected to the connector 22 via the connection 74. The tubular string 26 is connected via the connection 72. Thus, in this configuration, physical access is provided between the tubular string 64 and the tubular string 24 through the connector 22.

Referring additionally now to FIGS. 5A-E, detailed cross-sectional views of the junction assembly 20 as installed in the wellbore sections 14, 16, 18 of the well system 10 are representatively illustrated. For clarity, the remainder of the well system 10 is not illustrated in FIGS. 5A-E.

In FIGS. 5A-E, it may be clearly seen how the features of the junction assembly 20 cooperate to provide for a convenient and effective installation in the wellbore sections 14, 16, 18. Note that the tubular string 64*a* is not yet installed in the FIGS. 5A-E configuration, and it should be understood that it is not necessary, in keeping with the scope of this disclosure, for the tubular string 64*a* to be installed at all.

Figure 6:
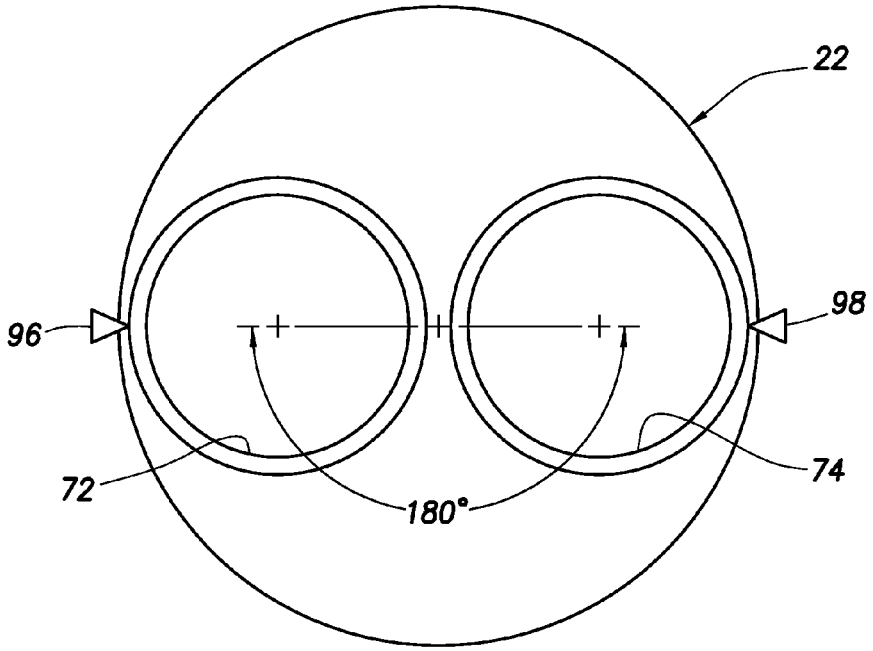
FIG. 6 is a representative bottom end view of the tubular string connector.

Referring additionally now to FIG. 6, a bottom view of the connector 22 is representatively illustrated. In this view, it may be seen that, if two of the connections 72, 74 are provided at the lower end 28 of the connector 22, then preferably the connections 72, 74 are oriented 180 degrees relative to one another.

As depicted in FIG. 6, a feature 96 of the connection 72 which controls the rotational orientation of a tubular string connected to the connection is indicated with a small triangle (the triangle represents the position of the feature, rather than the feature itself). This feature 96 could be a start of a thread, an end of a thread, a portion of a J-slot, etc. Any feature which controls the rotational orientation of a tubular string connected to the connector 22 by connection 72 may be used as the feature 96.

The connection 74 has a similar feature 98. Note that the features 96, 98, along with the remainder of the connections 72, 74, are oriented 180 degrees with respect to each other. In this manner, a tubular string would be rotated 180 degrees between being operatively connected to the connector 22 by one of the connections 72, 74, and being operatively connected by the other of the connections. Of course, other rotational orientations of the connections 72, 74 may be used, in keeping with the scope of this disclosure.

Figure 7:
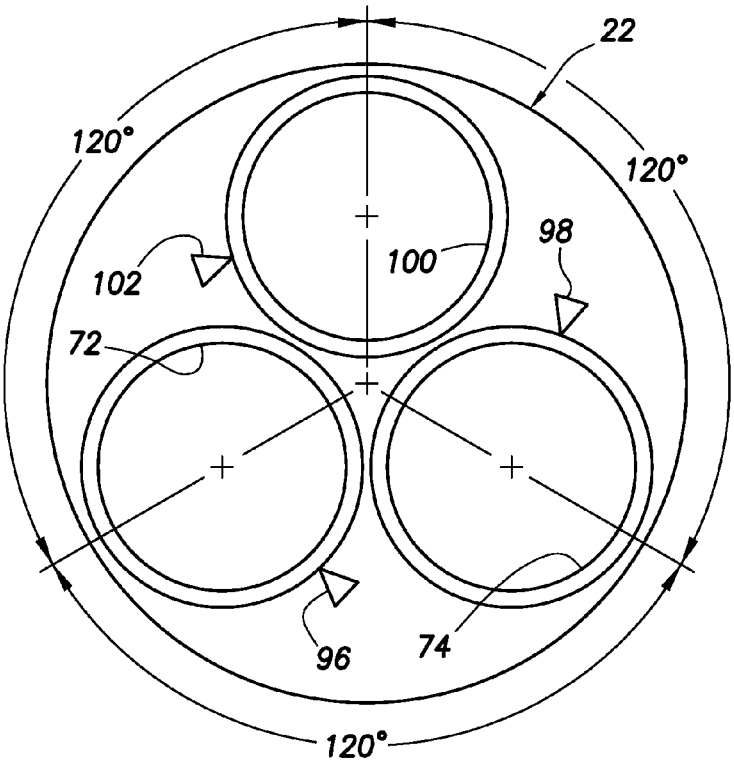
FIG. 7 is a representative bottom end view of another configuration of the tubular string connector.

Referring additionally now to FIG. 7, another configuration of the connector 22 is representatively illustrated. In this configuration, three connections 72, 74, 100 are provided at the bottom end 28 of the connector 22. The connection 100 may be an oriented connection, and/or the connection 100 may be similarly dimensioned to the other connections 72, 74, so that a same tubular string could be connected to any of the connections 72, 74, 100.

The example of FIG. 7 demonstrates that any number of connections may be provided on the connector 22 in keeping with the scope of this disclosure. Additionally, note that the connections 72, 74, 100 are oriented 120 degrees relative to one another, demonstrating that any orientation of connections may be used in keeping with the scope of this disclosure.

The features 96, 98 are differently oriented in the FIG. 7 example, as compared to the FIG. 6 example. However, the features 96, 98 (and a similar feature 102 of the connection 100) are preferably also rotationally oriented 120 degrees relative to one another. This demonstrates that any rotational orientation of features may be used in keeping with the scope of this disclosure.

Although in FIGS. 6 & 7 the connections 72, 74, 100 are depicted as being equally angularly spaced apart, and the features 96, 98, 102 are depicted as being equally rotationally shifted relative to each other, the scope of this disclosure encompasses non-equal angular spacing of the connections and non-equal rotational displacement between the features of the connections.

Figure 8:
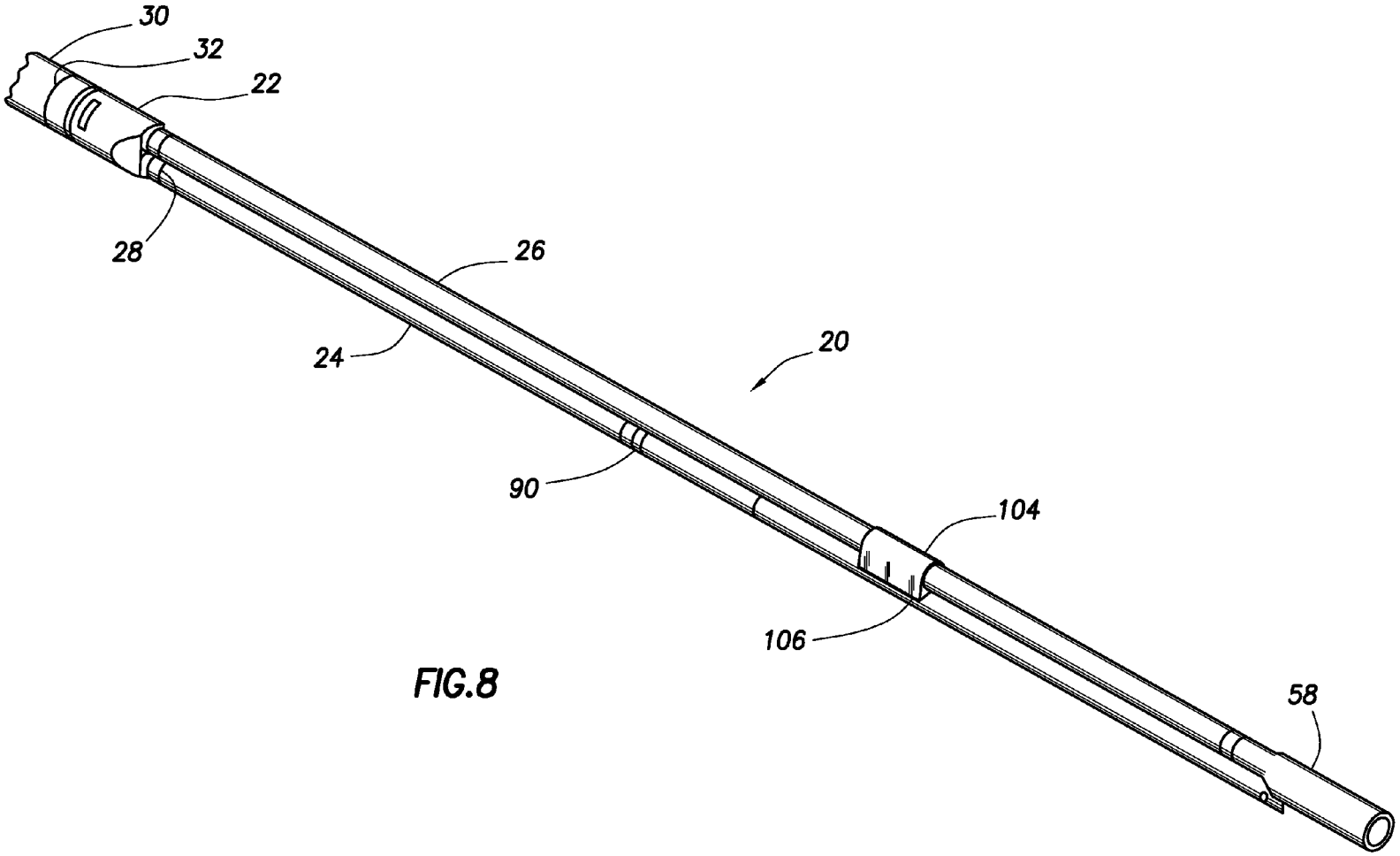
FIG. 8 is a representative isometric view of another configuration of the wellbore junction assembly.

Referring additionally now to FIG. 8, another configuration of the wellbore junction assembly 20 is representatively illustrated. In this configuration, the tubular string 26 (which is to be deflected laterally into the wellbore section 18) includes a tubular string support 104 for decreasing bending stress in, and preventing buckling of, the tubular string 26 during installation.

The support 104 can be interconnected in the tubular string 26 in various ways. For example, the support 104 could be provided with threads (such as oriented threads, or another type of oriented connection) for connection between upper and lower sections of the tubular string 26, or the support could be slid over the exterior of the tubular string and secured with set screws, clamps, etc. Thus, it will be appreciated that any manner of attaching the support 104 to, or interconnecting the support in, the tubular string 26 may be used in keeping with the scope of this disclosure.

The support 104 preferably extends at least partially adjacent the other tubular string 24. For example, the support 104 could at least partially straddle the tubular string 24 as depicted in FIG. 8.

Laterally extending "legs" 106 of the support 104 can be configured with various lateral lengths, which space the tubular string 26 away from elements such as the deflector 48, the window 46, the wellbore section 18, etc. This spacing away of the tubular string 26 from such elements functions to reduce bending of the tubular string as it is being installed in the wellbore section 18, as described more fully below.

In the configuration of FIG. 8, the legs 106 of the support 104 extend to approximately a maximum outer diameter of the tubular string 24 adjacent the support. Preferably, the support 104 (including the legs 106) does not extend laterally outward any more than does the connector 22, so that the support and the tubular strings 24, 26 can pass through the same upper wellbore section 14 during installation.

Figure 9:
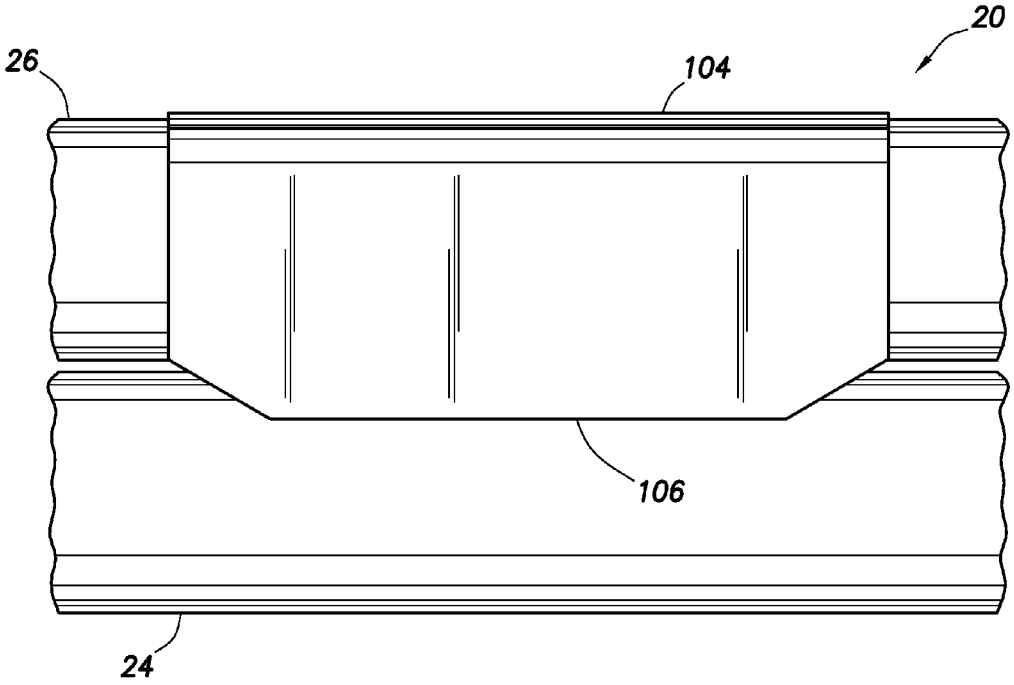
FIG. 9 is a representative side view of a tubular string support of the wellbore junction assembly.

Referring additionally now to FIG. 9, a side view of the support 104 is representatively illustrated at an enlarged scale. In this configuration, the legs 106 do not extend as far laterally outward as in the FIG. 8 configuration. Thus, the tubular string 26 will not be spaced as far away from various elements of the well system 10 (e.g., the deflector 48, the window 46, the wellbore section 18, etc.) as compared to the configuration of FIG. 8 during installation of the junction assembly 20.

Figure 10:
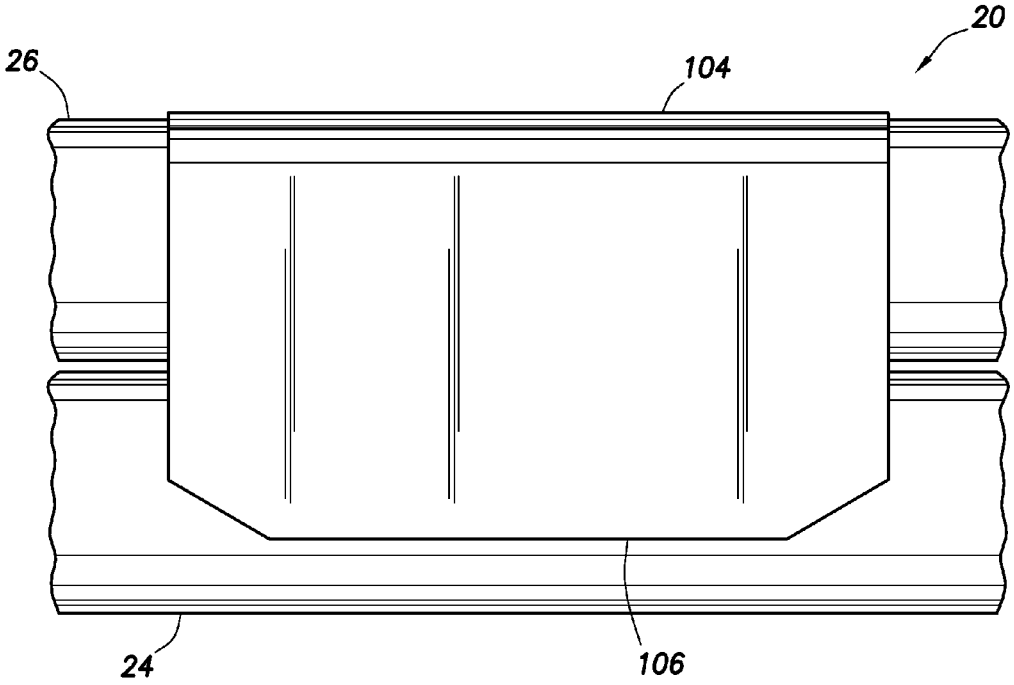
FIG. 10 is a representative side view of another configuration of the tubular string support.

Referring additionally now to FIG. 10, another configuration of the support 104 is representatively illustrated. In this configuration, the legs 106 extend laterally outward a greater distance as compared to the FIGS. 8 & 9 configurations. Thus, the tubular string 26 will be spaced farther away from various elements of the well system 10 (e.g., the deflector 48, the window 46, the wellbore section 18, etc.) as compared to the configuration of FIGS. 8 & 9 during installation of the junction assembly 20.

Figure 11:
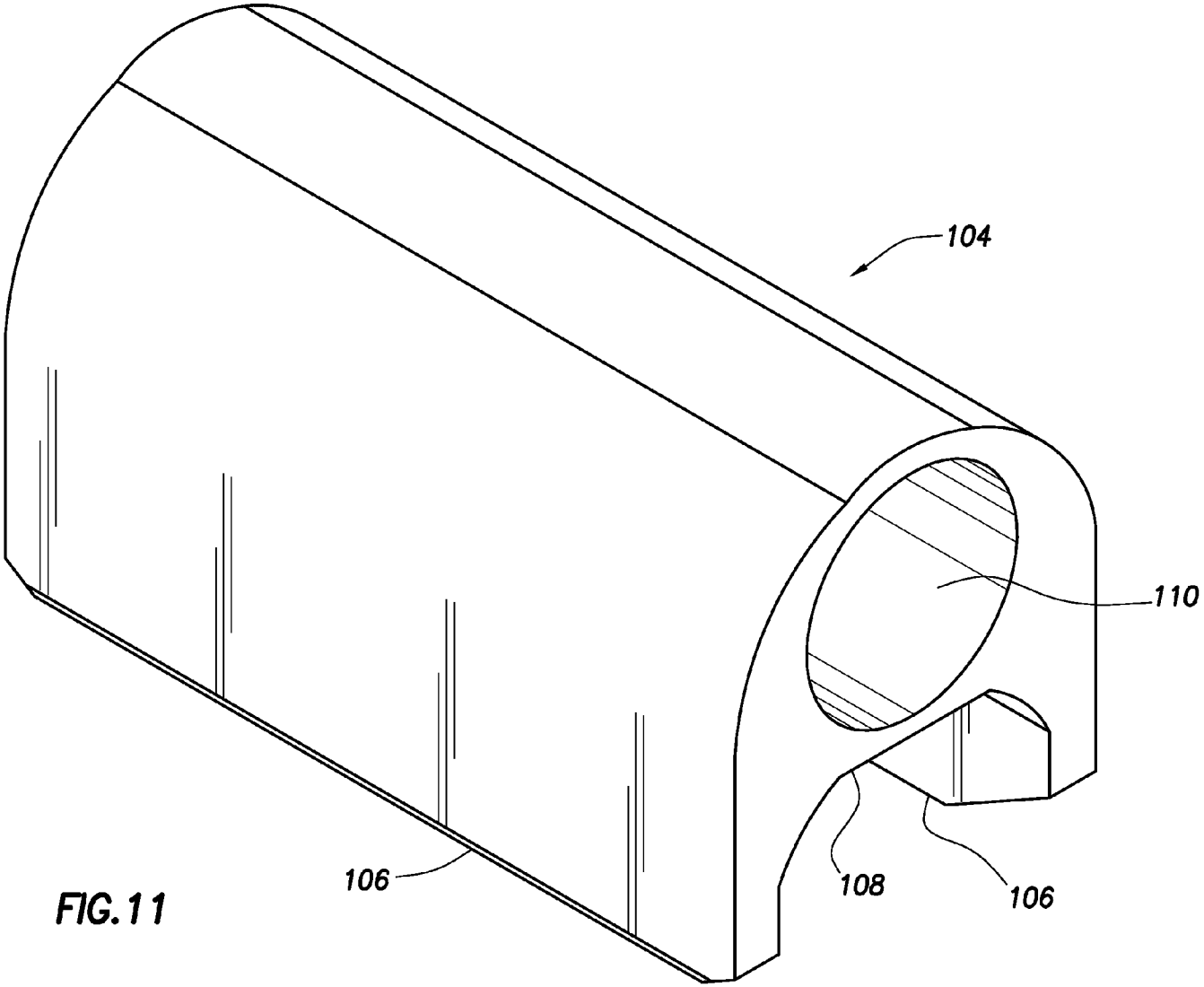
FIG. 11 is a representative isometric view of yet another configuration of the tubular string support.

Referring additionally now to FIG. 11, yet another configuration of the support 104 is representatively illustrated, apart from the remainder of the junction assembly 20. In this view, the manner in which the legs 106 can straddle the tubular string 24 may be clearly seen.

Prior to the tubular string 26 being deflected laterally into the wellbore section 18, the tubular string 24 is received in a longitudinal recess 108 formed on the support 104. An opening 110 formed longitudinally through the support 104 can be provided with oriented connections (such as oriented threads, J-slots, etc.), or the opening can be large enough to receive the tubular string 26 therein, in which case set screws, clamps or another means may be used to secure the support onto the tubular string.

Figure 12:
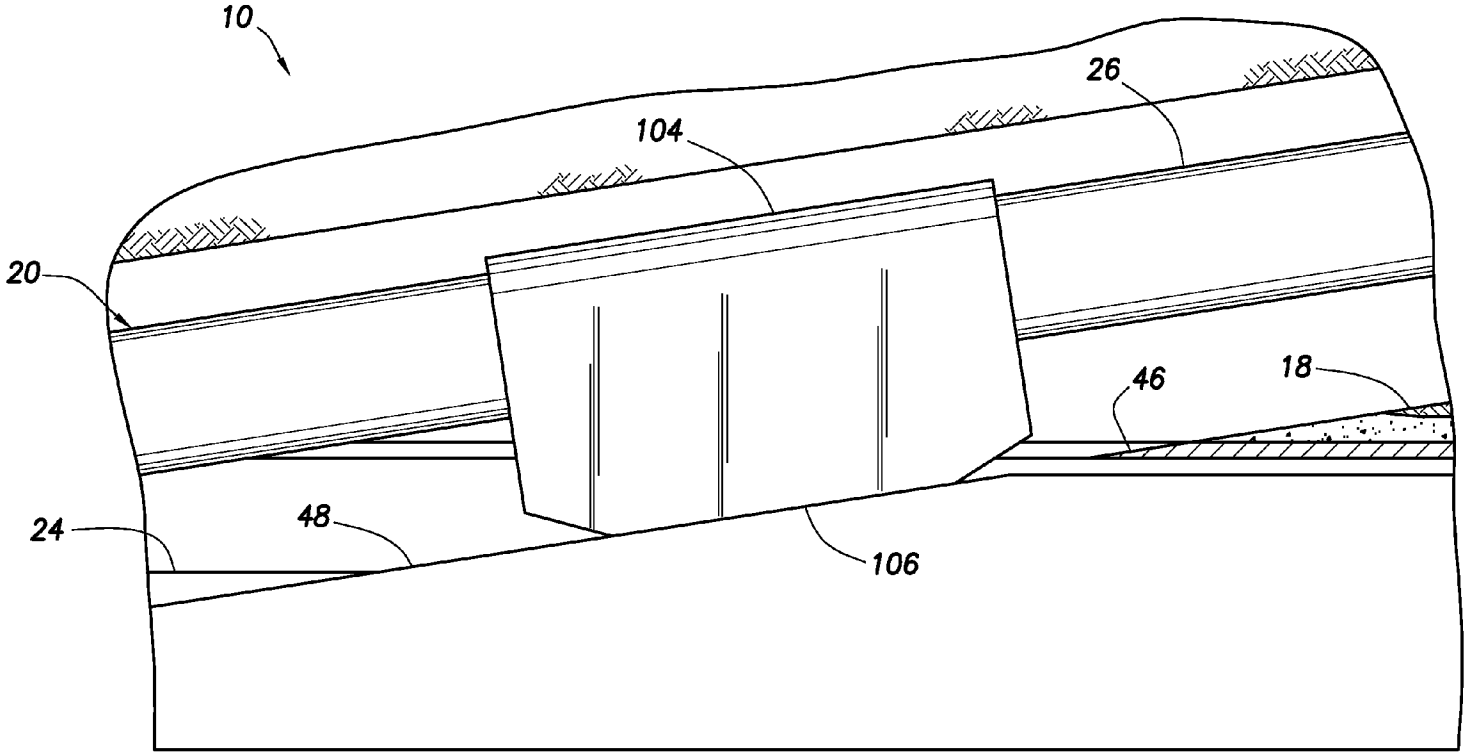
FIG. 12 is a representative partially cross-sectional view of the wellbore junction assembly being installed in the well system 10.

Referring additionally now to FIG. 12, the tubular string 26 is representatively illustrated as it is being deflected laterally into the wellbore section 18 during installation of the junction assembly 20. Note that the legs 106 of the support 104 space the tubular string 26 away from the deflector 48 and, upon further installation, will space the tubular string away from the window 46 and the wellbore section 18.

This spacing away of the tubular string 26 by the support 104 reduces bending of the tubular string, thereby reducing bending stresses in the tubular string. If an obstruction or restriction is encountered by the tubular string 26 during installation into the wellbore section 18, this reduced bending of the tubular string can also prevent buckling of the tubular string, particularly if additional longitudinal force is applied to the tubular string (e.g., by setting down weight on the assembly 20, etc.) in order to traverse the obstruction or restriction.

Support of the tubular string 26 in this manner can be especially beneficial in horizontal or substantially deviated wellbore sections, such as the wellbore section 18 as depicted in FIG. 12. In that case, the tubular string 26 can be subjected to the force of gravity, tending to make the tubular string lie against the deflector 48, window 46 and the lower side of the wellbore section 18 during installation.

Figure 13A:
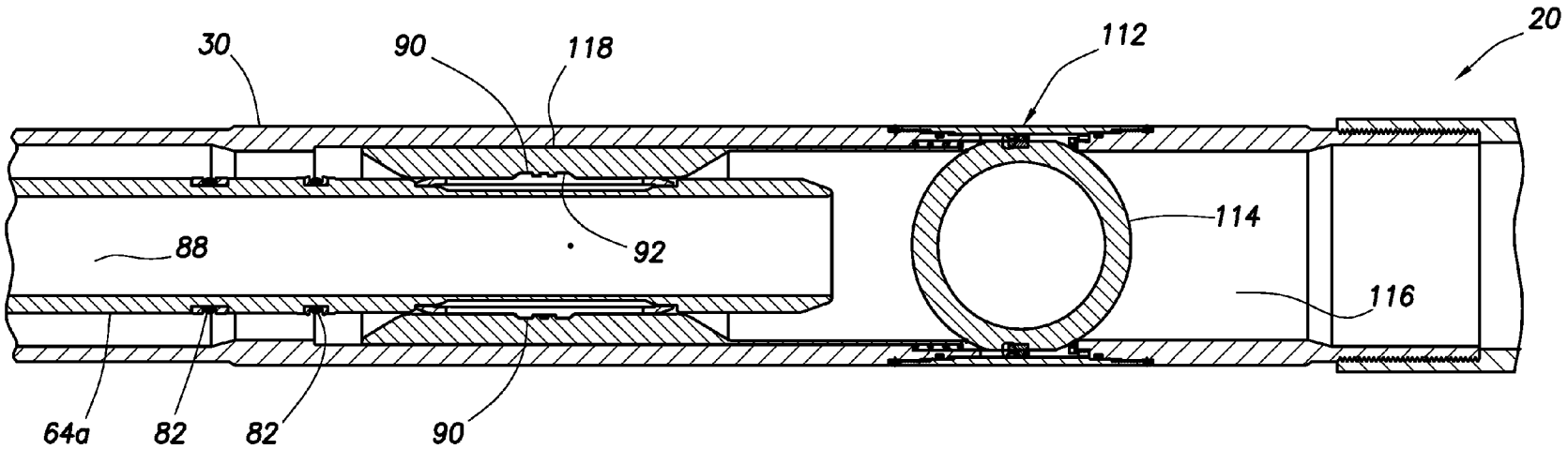
FIGS. 13A & B are representative cross-sectional views of a flow control device of the wellbore junction assembly in closed and open configurations.

Referring additionally now to FIGS. 13A & B, another configuration of the wellbore junction assembly 20 is representatively illustrated. In this configuration, a flow control device 112 in the tubular string 30 above the connector 22 is opened as the tubular string 64*a* is installed in the junction assembly 20.

In FIG. 13A, the flow control device 112 is closed prior to the tubular string 64*a* being fully installed in the junction assembly 20. In this configuration, a closure 114 of the device 112 prevents flow through an internal flow passage 116 of the tubular string 30.

With flow through the passage 116 being blocked (as depicted in FIG. 13A) valuable completion fluids, muds, or other fluids are prevented from flowing through the junction assembly 20 into the wellbore sections 16, 18, where they could be lost to earth strata surrounding these wellbore sections. If the wellbore sections 16, 18 are completed in an underbalanced condition, then the device 112 in its closed configuration can prevent increased pressure above the wellbore junction 20 from being communicated with the wellbore sections 16, 18, which communication could otherwise damage the earth strata intersected by the wellbore sections. Elevated pressure above the device 112 could in some circumstances cause undesired fracturing or other damage to the earth strata intersected by the wellbore sections 16, 18, if not for the device being closed.

The device 112 may be of the type known to those skilled in the art as a fluid loss control device. In FIGS. 13A & B, the device 112 is depicted as a ball valve, with the closure 114 comprising a rotatable ball. However, in other examples, the device 112 could comprise a flapper valve or other type of openable flow blocking device.

One suitable flow blocking device is the Anvil™ plug marketed by Halliburton Energy Services, Inc. of Houston, Tex. USA, which comprises a shearable closure. Yet another suitable flow blocking device is the Mirage™ disappearing plug, also marketed by Halliburton Energy Services, Inc., which comprises a dispersible closure. Therefore, it will be appreciated that any means of blocking flow through the passage 116, and then permitting flow through the passage, may be used in keeping with the scope of this disclosure.

In the example of FIGS. 13A & B, the device 112 is opened in response to installation of the tubular string 64*a* into the tubular string 30. In this configuration, the latch 90 complementarily engages the profile 92 (which is formed in a sleeve 118 reciprocably disposed in the tubular string 30) when the tubular string 64*a* is inserted into the tubular string 30.

Figure 13B:
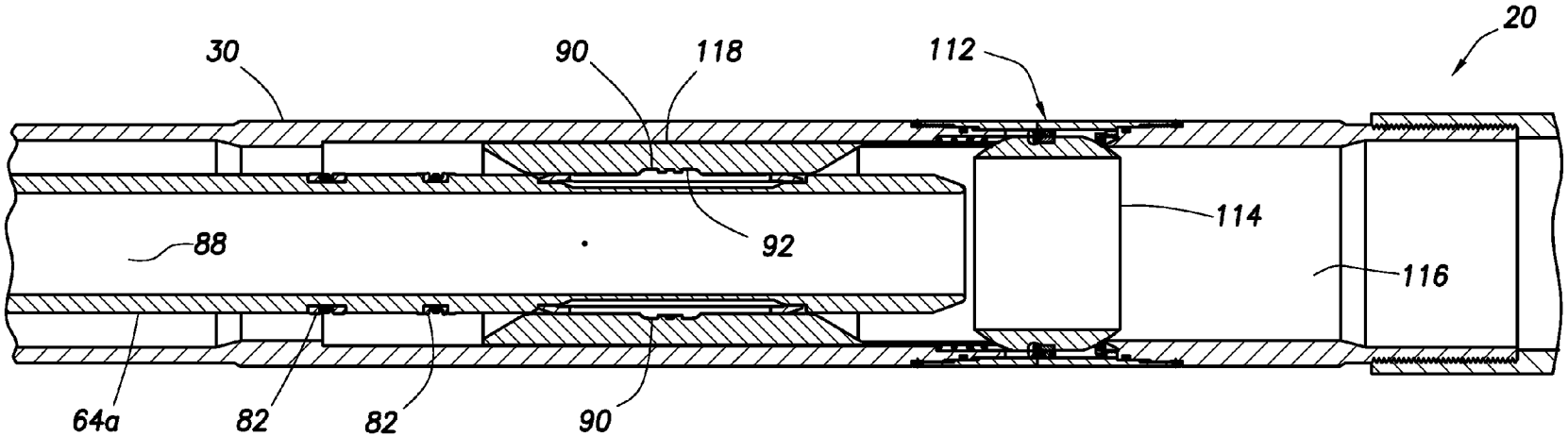

As depicted in FIG. 13A, the tubular string 64*a* has been inserted sufficiently far into the tubular string 30 for the latch 90 to engage the profile 92 in the sleeve 118. As depicted in FIG. 13B, the tubular string 64*a* has been further inserted into the tubular string 30, and the sleeve 118 has thereby been displaced with the tubular string 64*a*.

Displacement of the sleeve 118 with the tubular string 64*a* causes the closure 114 to open, as shown in FIG. 13B. In this example, the closure 114 is rotated to an open position, but in other examples the closure could be sheared, broken, pivoted, dissolved or otherwise dispersed, etc., so that flow is permitted through the passage 116.

After the device 112 is opened, the tubular string 64*a* can be further inserted into the tubular string 30, with the latch 90 disengaging the profile 92 (for example, as a result of applying a sufficient longitudinal force to the tubular string 64*a*, e.g., by setting down weight on the tubular string, etc.).

Figure 14A:
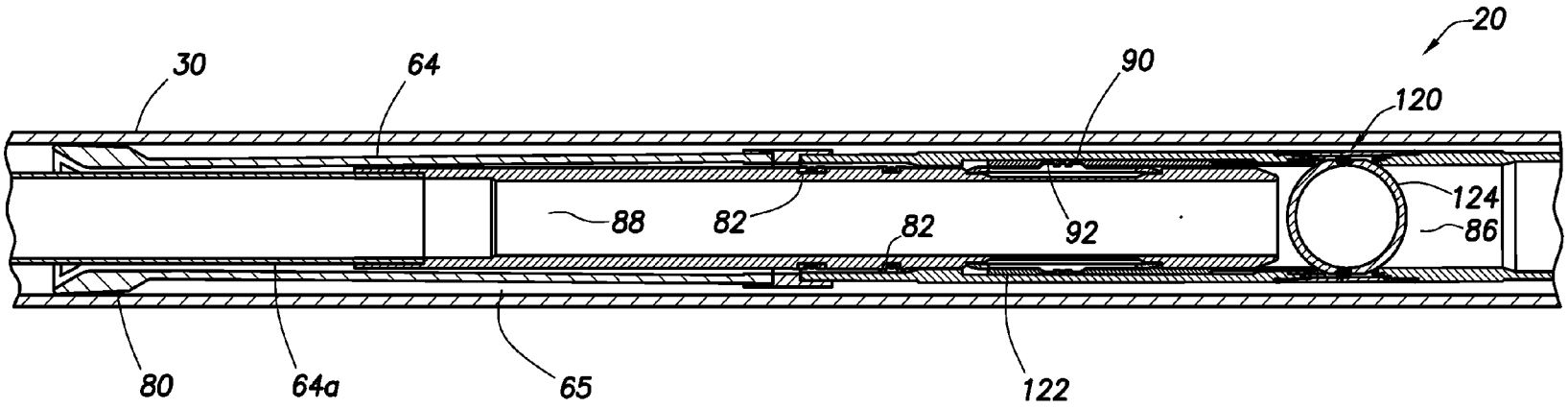
FIGS. 14A & B are representative cross-sectional views of another flow control device of the wellbore junction assembly in closed and open configurations.

Referring additionally now to FIGS. 14A & B, a section of the wellbore junction assembly 20 is representatively illustrated after the tubular string 64*a* has been inserted further into the junction assembly. More specifically, the tubular string 64*a* has been inserted partially into the tubular string 64.

In FIG. 14A, the tubular string 64*a* has been inserted sufficiently far into the tubular string 64 for the latch 90 to complementarily engage another profile 92 of another flow control device 120 interconnected in the tubular string 64. The flow control device 120 may be the same as, similar to, or different from the flow control device 112 interconnected in the tubular string 30.

In this example, the profile 92 is formed in a sleeve 122 which is reciprocably disposed relative to the passage 86 in the tubular string 64. Displacement of the sleeve 122 causes opening of a closure 124 of the device 120.

Figure 14B:
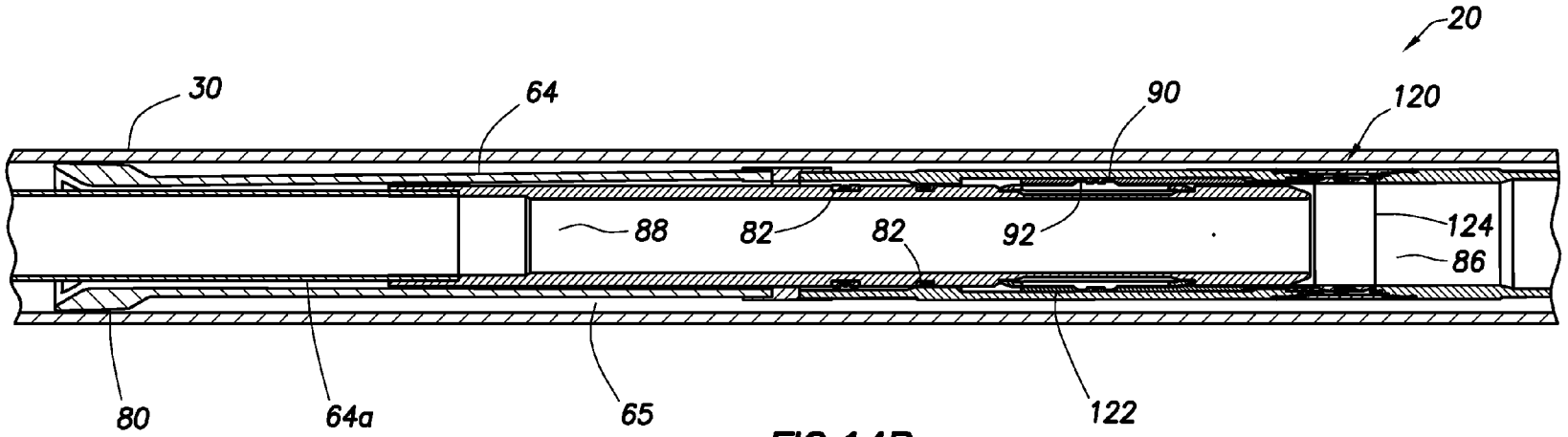

In FIG. 14B, the closure 124 has been opened, thereby permitting flow through the passage 86. After the device 120 is opened, the tubular string 64*a* can be further inserted into the tubular string 64, with the latch 90 disengaging the profile 92 (for example, as a result of applying a sufficient longitudinal force to the tubular string 64*a*, e.g., by setting down weight on the tubular string, etc.).

The device 120 in its closed configuration preferably prevents fluid flow between the wellbore sections 16, 18. With the device 120 closed (as depicted in FIG. 14A), fluid cannot flow between the space 65 and the passage 86 below the device. Thus, if the earth strata intersected by the wellbore sections 16, 18 have different formation pressures, the device 120 in its closed configuration will prevent transfer of fluid from a higher pressure earth strata to a lower pressure earth strata.

It can now be seen that insertion of the tubular string 64*a* into the junction assembly 20 can be used to open the device 112, and then to open the device 120. The devices 112, 120 are opened in response to the displacement of the tubular string 64*a* through the tubular string 30 (thereby opening the device 112), and in response to displacement of the tubular string 64*a* through the tubular string 64 (thereby opening the device 120).

Opening of the device 112 provides fluid communication between upper and lower sections of the tubular string 30, and opening of the device 120 provides fluid communication between upper and lower sections of the tubular string 64. Stated differently, opening of the device 112 provides fluid communication through an upper section of the junction assembly 20, and opening of the device 120 provides fluid communication between the tubular strings 24, 26, and between the wellbore sections 16, 18.

It may now be fully appreciated that this disclosure provides significant improvements to the art of constructing wellbore junctions. The tubular string connector 22 described above can be used to determine which of multiple tubular strings 24, 26 can be physically accessed after installation of the junction assembly 20. The tubular strings 24, 26 can be interchangeably connected to the connector 22 with the oriented connections 72, 74.

The above disclosure describes a method of installing a wellbore junction assembly 20 in a well. The method can include connecting at least first and second tubular strings 24, 26 to a first opposite end 28 of a tubular string connector 22 with similarly dimensioned oriented connections 72, 74, whereby the first and second tubular strings 24, 26 are interchangeably connectable to the connector 22 with the oriented connections 72, 74.

The connecting step can include each of the first and second tubular strings 24, 26 having a rotational orientation relative to the connector 22 which is determined by the respective oriented connection 72 or 74.

The method can include orienting the oriented connections 72, 74 on the connector 180 degrees with respect to each other, and/or substantially equally angularly spacing the oriented connections apart from each other.

The method can include connecting a third tubular string 30 to a second opposite end 32 of the connector 22. The method can also include connecting a fourth tubular string 64 to the second opposite end 32 of the connector 22. The fourth tubular string 64 may be positioned at least partially within the third tubular string 30.

Access may be permitted via the connector 22 between the fourth tubular string 64 and only one of the first and second tubular strings 24, 26.

The fourth tubular string 64 can comprise a seal bore 84. A fifth tubular string 64*a* may be sealingly installed in the seal bore 84.

The method may include opening a flow control device 120 in response to installing a fifth tubular string 64*a* in the fourth tubular string 64. Opening the flow control device 120 may comprise permitting fluid communication through a longitudinal flow passage 86 of the fourth tubular string 64.

The method may also include opening a second flow control device 112 in response to installing the fifth tubular string 64*a* in the third tubular string 30. Opening the second flow control device 112 may comprise permitting fluid communication through a longitudinal flow passage 116 of the third tubular string 30.

The method may include laterally spacing the second tubular string 26 away from a deflector 48 with a support 104 connected in the second tubular string 26, while the deflector 48 laterally deflects the second tubular string 26 into a wellbore section 18. The support 104 may space the second tubular string 26 laterally away from a lower side of the wellbore section 18.

The support 104 may at least partially straddle the first tubular string 24 prior to deflection of the second tubular string 26 into the wellbore section 18. The support 104 may reduce bending of the second tubular string 26 when the second tubular string 26 is installed in the wellbore section 18.

Also described above is a wellbore junction assembly 20. The junction assembly 20 can include at least first and second tubular strings 24, 26, and a tubular string connector 22 having first and second opposite ends 28, 32. Each of the first and second tubular strings 24, 26 may be secured to the first opposite end 28 by oriented connections 72, 74, whereby each of the first and second tubular strings 24, 26 has a fixed rotational orientation relative to the connector 22.

The above disclosure also provides to the art a well system 10. The well system 10 can include a tubular string connector 22 having first and second opposite ends 28, 32, first and second tubular strings 24, 26 secured to the first opposite end 28, the first and second tubular strings 24, 26 being disposed in separate intersecting wellbore sections 16, 18, third and fourth tubular strings 30, 64 secured to the second opposite end 32, the fourth tubular string 64 being disposed within the third tubular string 30, a first flow control device 120 which selectively permits and prevents fluid flow through a longitudinal flow passage 116 of the third tubular string 30, and a second flow control device 112 which selectively permits and prevents fluid flow through a longitudinal flow passage 86 of the fourth tubular string 64.

The first flow control device 120 may open in response to insertion of a fifth tubular string 64*a* into the fourth tubular string 64.

The second flow control device 112 may open in response to insertion of a fifth tubular string 64*a* into the third tubular string 30. The first flow control device 120 may open in response to insertion of the fifth tubular string 64*a* through the second flow control device 112 and into the fourth tubular string 64.

The second flow control device 112 may selectively permit and prevent fluid communication between the wellbore portions 16, 18. The first flow control device 120 may selectively permit and prevent fluid communication between the wellbore portions 16, 18 and the third tubular string 30.

Also described above is a well system 10 which can include a tubular string connector 22 having opposite ends 28, 32, and each of first and second tubular strings 24, 26 being secured to the connector 22, and a support 104 which reduces bending of the second tubular string 26 which results from deflection of the second tubular string 26 from a first wellbore section 14 into a second wellbore section 18.

The support 104 may space the second tubular string 26 away from a deflector 48 which deflects the second tubular string 26 into the second wellbore section 18. The support 104 may space the second tubular string 26 away from a lower side of the second wellbore section 18.

The support 104 may at least partially straddle the first tubular string 24.

The first and second tubular strings 24, 26 can be connected to the same end 28 of the connector 22.

The first tubular string 24 may be disposed in a third wellbore section 16.

It is to be understood that the various examples described above may be utilized in various orientations, such as inclined, inverted, horizontal, vertical, etc., and in various configurations, without departing from the principles of this disclosure. The embodiments illustrated in the drawings are depicted and described merely as examples of useful applications of the principles of the disclosure, which are not limited to any specific details of these embodiments.

In the above description of the representative examples, directional terms (such as "above," "top," "below," "bottom," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of this disclosure. Accordingly, the foregoing detailed description is to be clearly understood as being given by way of illustration and example only, the spirit and scope of the invention being limited solely by the appended claims and their equivalents.

What is claimed is:

1. A method of installing a wellbore junction assembly in a well, the method comprising:

connecting at least first and second tubular strings to a first opposite end of a tubular string connector with similarly dimensioned oriented connections, whereby the first and second tubular strings are interchangeably connectable to the connector by the oriented connections;

connecting a third tubular string to a first female connector on a second opposite end of the connector; and connecting a fourth tubular string to a second female connector on the second opposite end of the connector, wherein the fourth tubular string is positioned at least partially within the third tubular string.

2. The method of claim 1, wherein access is permitted via the connector between the fourth tubular string and only one of the first and second tubular strings.

3. The method of claim 1, wherein the fourth tubular string comprises a seal bore.

4. The method of claim 3, further comprising sealingly installing a fifth tubular string in the seal bore.

5. The method of claim 1, further comprising opening a first flow control device in response to installing a fifth tubular string in the fourth tubular string.

6. The method of claim 5, wherein opening the first flow control device further comprises permitting fluid communication through a longitudinal flow passage of the fourth tubular string.

7. The method of claim 5, further comprising opening a second flow control device in response to installing the fifth tubular string in the third tubular string.

8. The method of claim 7, wherein opening the second flow control device further comprises permitting fluid communication through a longitudinal flow passage of the third tubular string.

9. A wellbore junction assembly, comprising:

at least first and second tubular strings; and a tubular string connector having first and second opposite ends, and each of the first and second tubular strings being secured to the first opposite end by oriented connections, whereby each of the first and second tubular strings has a fixed rotational orientation relative to the connector and that each of the first and second tubular strings are interchangeably connectable to the connector, wherein a third tubular string is connected to a first female connector on the second opposite end of the connector, wherein a fourth tubular string is connected to a second female connector on the second opposite end of the connector, and wherein the fourth tubular string is positioned within the third tubular string.

10. The wellbore junction assembly of claim 9, wherein access is permitted via the connector between the fourth tubular string and only one of the first and second tubular strings.

11. The wellbore junction assembly of claim 9, wherein the fourth tubular string comprises a seal bore.

12. The wellbore junction assembly of claim 9, wherein a first flow control device opens in response to installation of a fifth tubular string in the fourth tubular string.

13. The wellbore junction assembly of claim 12, wherein the first flow control device selectively prevents and permits fluid communication through a longitudinal flow passage of the fourth tubular string.

14. The wellbore junction assembly of claim 12, wherein a second flow control device opens in response to installation of the fifth tubular string in the third tubular string.

15. The wellbore junction assembly of claim 14, wherein the second flow control device selectively prevents and permits fluid communication through a longitudinal flow passage of the third tubular string.

16. A wellbore junction assembly, comprising:

at least first and second tubular strings; and a tubular string connector having first and second opposite ends, and each of the first and second tubular strings being secured to the first opposite end by oriented connections, whereby each of the first and second tubular strings has a fixed rotational orientation relative to the connector, wherein a third tubular string is connected to the second opposite end of the connector, wherein a fourth tubular string is connected to the second opposite end of the connector, wherein the fourth tubular string comprises a seal bore, and wherein a fifth tubular string is sealingly received in the seal bore.

17. A well system, comprising:

a tubular string connector having first and second opposite ends;

first and second tubular strings secured to the first opposite end, the first and second tubular strings being disposed in separate intersecting wellbore sections;

ends of third and fourth tubular strings connected to respective connections at the second opposite end, the fourth tubular string being disposed within the third tubular string;

a first flow control device which selectively permits and prevents fluid flow through a longitudinal flow passage of the third tubular string; and a second flow control device which selectively permits and prevents fluid flow through a longitudinal flow passage of the fourth tubular string.

18. The well system of claim 17, wherein the first flow control device opens in response to insertion of a fifth tubular string into the fourth tubular string.

19. The well system of claim 17, wherein the second flow control device opens in response to insertion of a fifth tubular string into the third tubular string.

20. The well system of claim 19, wherein the first flow control device opens in response to insertion of the fifth tubular string through the second flow control device and into the fourth tubular string.

21. The well system of claim 17, wherein the second flow control device selectively permits and prevents fluid communication between the wellbore portions.

22. The well system of claim 17, wherein the first flow control device selectively permits and prevents fluid communication between the wellbore portions and the third tubular string.

* * * * *